US012270578B2

(12) United States Patent
Peter-Borie et al.

(10) Patent No.: US 12,270,578 B2
(45) Date of Patent: Apr. 8, 2025

(54) SYSTEM AND METHOD FOR ENERGY AND RESOURCE EXTRACTION WITH REDUCED EMISSIONS

(71) Applicant: CGG SERVICES SAS, Massy (FR)

(72) Inventors: Mariane Peter-Borie, Saint Nexans (FR); Robert Crossley, Conwy (GB); Elisha Drumm, Bridge of Weir (GB); Johannes Potgieter, Longfield (GB); Max Norman, Llandudno (GB); Mark Williams, Llandudno (GB)

(73) Assignee: CGG SERVICES SAS, Massy (FR)

( * ) Notice: Subject to any disclaimer, the term of this patent is extended or adjusted under 35 U.S.C. 154(b) by 0 days.

(21) Appl. No.: 18/726,526

(22) PCT Filed: Dec. 22, 2023

(86) PCT No.: PCT/EP2023/087689

§ 371 (c)(1),
(2) Date: Jul. 3, 2024

(87) PCT Pub. No.: WO2024/126875

PCT Pub. Date: Jun. 20, 2024

(65) Prior Publication Data

US 2025/0067481 A1 Feb. 27, 2025

(30) Foreign Application Priority Data

Aug. 1, 2023 (FR) ..... 2308350

(51) Int. Cl.
*F24T 10/17* (2018.01)
*E21B 41/00* (2006.01)
*E21B 43/295* (2006.01)

(52) U.S. Cl.
CPC ..... *F24T 10/17* (2018.05); *E21B 41/0064* (2013.01); *E21B 43/295* (2013.01)

(58) Field of Classification Search
CPC ..... F24T 10/17; E21B 41/0064; E21B 43/295
(Continued)

(56) References Cited

U.S. PATENT DOCUMENTS 4,019,577 A 4/1977 Fitch et al.
7,431,084 B1 10/2008 Upadhye
(Continued)

FOREIGN PATENT DOCUMENTS

CN 102434143 A 5/2012
CN 106026778 A 10/2016
(Continued)

OTHER PUBLICATIONS

Christopher Otto et al., "Fault Reactivation Can Generate Hydraulic Short Circuits in Underground Coal Gasification—New Insights from Regional-Scale Thermo-Mechanical 3D Modeling," Minerals, 2016, vol. 6, No. 4, pp. 1-18.
(Continued)

*Primary Examiner* — Jorge L Leon, Jr.
(74) *Attorney, Agent, or Firm* — PATENT PORTFOLIO BUILDERS PLLC

(57) ABSTRACT

A heat extraction system for extracting heat from a reservoir, the system including a co-axial tool configured to be placed underground, the co-axial tool having an outer pipe and an inner pipe located within the outer pipe, each of the outer pipe and the inner pipe being connected to a shoe so that a fluid flows through an annulus defined by the inner and outer pipes, reaches the shoe, and flows through a bore of the inner pipe; and a power generator fluidly connected to a chemical processing unit to receive a fluid, and also fluidly connected with a first port to the inner pipe and with a second port to the outer pipe of the co-axial tool. A temperature difference of the fluid at the power generator and at the co-axial tool drives the power generator to generate energy.

20 Claims, 20 Drawing Sheets

(58) Field of Classification Search
USPC ..... 60/641.2
See application file for complete search history.

(56) References Cited

U.S. PATENT DOCUMENTS

| | | | | |
|---|---|---|---|---|
| 10,816,241 | B2 | 10/2020 | Zhong et al. | |
| 11,255,576 | B2 | 2/2022 | Higgins et al. | |
| 2013/0333383 | A1* | 12/2013 | Schwarck | F24T 10/10 165/45 |
| 2021/0048229 | A1 | 2/2021 | Niemi et al. | |
| 2021/0062682 | A1 | 3/2021 | Higgins et al. | |

FOREIGN PATENT DOCUMENTS

| | | | |
|---|---|---|---|
| CN | 106121617 | A | 11/2016 |
| CN | 108534380 | A | 9/2018 |
| CN | 209586351 | U | 11/2019 |
| CN | 111022026 | A | 4/2020 |
| CN | 212867523 | U | 4/2021 |
| CN | 113863910 | A | 12/2021 |
| CN | 215408574 | U | 1/2022 |
| CN | 114837648 | A | 8/2022 |
| RU | 2716534 | C1 | 3/2020 |
| RU | 2756624 | C1 | 10/2021 |
| WO | 2008033268 | A1 | 3/2008 |
| WO | 2014177188 | A1 | 11/2014 |
| WO | 2017103950 | A1 | 6/2017 |

OTHER PUBLICATIONS

Dorota Burchart-Korol et al., "Life cycle assessment of heat production from underground coal gasification," Springer, 2016, The International Journal of Life Cycle Assessment, vol. 21, pp. 1391-1403.

Hannah Ritchie, Pablo Rosado and Max Roser (2023)—"Energy" Published online at OurWorldInData.org. Retrieved from: 'https://ourworldindata.org/energy' [Online Resource].

Hussam Jouhara et al., "Waste heat recovery technologies and applications," Thermal Science and Engineering Progress, 2018, vol. 6, pp. 268-289.

International Search Report/Written Opinion dated Apr. 12, 2024 in related/corresponding PCT Application No. PCT/EP2023/087689.

Krzysztof Stańczyk et al., "Experimental simulation of hard coal underground gasification for hydrogen production," Elsevier, 2012, Fuel 91, pp. 40-50.

L. H. Yang et al., "Hydrogen production in underground coal gasification (UCG)," Energy Sources, Part A: Recovery, Utilization, and Environmental Effects, vol. 38, No. 3, pp. 376-383.

Liangliang Jiang et al., "Coal decarbonization: A state-of-the-art review of enhanced hydrogen production in underground coal gasification," Energy Reviews, 2022, vol. 1, pp. 1-25.

Office Action dated Jan. 30, 2025 in related/corresponding RU Application No. 2024119119.

* cited by examiner

SYSTEM AND METHOD FOR ENERGY AND RESOURCE EXTRACTION WITH REDUCED EMISSIONS

BACKGROUND OF THE INVENTION

Technical Field

Embodiments of the subject matter disclosed herein generally relate to a system and method for extracting energy and/or valuable resources from a coal or similar reservoir, and more particularly, to a process and associated system for exploiting an underground coal reservoir without mining the coal and bringing it to the surface for being burned in a power facility, which reduces pollution.

Discussion of the Background

Use of hydrogen gas and geothermal heat are two important components of the transition to green energy. In addition to being an essential resource used in the chemical industry, hydrogen, when burnt for power only, produces fresh water as a by-product. Geothermal energy use (either naturally generated by the Earth or humanly induced by, for example, burning coal at its underground location) is wide-ranging, from power generation to a multitude of localized, direct uses, such as district heating, industrial processing, agricultural and aquacultural heating, and recreational bathing.

Since the 1960s, global energy consumption has followed a linear growth trend (approximately 2,200 additional TWh per year) and coal remains one of the three main energy resources along with oil and gas, as illustrated in FIGS. 1A and 1B, which is taken from Ritchie, H., Roser, M. and Rosado, P. (2022). "Energy," Published online at OurWorldlnData.org., and retrieved from: ourworldindata.org/energy. Coal consumption keeps growing with time, and as a result, its contribution ratio to global consumption is remaining steady. Coal remains the dominant fuel source for energy and chemical production in many parts of the world. Decarbonizing coal exploitation appears to be one of the indispensable challenges to address if the world is to reduce $CO_2$ emissions rapidly and at scale.

Underground coal gasification (UCG) has been investigated since the beginning of the 20th century and several successful long-term production cases were developed. It is considered a promising option for advanced clean coal exploitation. UCG is an in-situ gasification process of naturally existing coal. The gasification process includes the controlled burning of coal strata or seam to produce a mixture of gases, called syngas, including methane and hydrogen, but carbon dioxide and carbon monoxide are also produced. Note that the coal strata is not extracted from the underground, but is burned in a controlled manner at its underground location.

Different development methods for the in-situ gasification of coal resources already exist. They all involve the introduction of steam and air or oxygen into a coal seam via an injection well, the ignition of the coal, and transport of the resulting gases to the surface via a production well. Regarding the exploitation design, there are various methods that involve injection and production wells linked by a range of processes including linked vertical well (LVW), controlled retractable injection point (CRIP), single well integrated flow tubing (SWIFT), and steeply dipping seams (SDS). The suitability of these UCG methods is dependent on parameters such as natural permeability of the coal seam, geochemistry of the coal, seam thickness, depth and inclination.

The proportions of the various component gases in the syngas are mainly a function of the quality and rank of the coal, the seam depth, and the gasifying agent (oxygen or air). FIGS. 2A and 2B show the syngas composition for different projects reported in the literature. The black line refers to gas calorific value, MJ/m3 (dry, STP), with the scale on the right axis of the chart, and the product gas volume % axis on the left of the chart, which refers to the bars. The main components of syngas are $H_2$, CO, $CH_4$, $CO_2$ along with $N_2$, $H_2S$ and COS. In principle, all these components can be used or reinjected into the ground, with no greenhouse gases (GHGs) emissions into the atmosphere, while providing useful elements for the energy transition. Some of these components provide fuel for power plants and raw material for the chemical industry.

For example, $H_2$, which is primarily used to produce chemical products, is now a promising energy source. Several trials have been implemented for enhanced hydrogen output in UCG [1-4]. Depending on the coal properties, depth, operating parameters, hydrogeological setting and the combustion process, hydrogen can be a main syngas product of UCG, and $CO_2$ and CO gas can be relatively minor components, as illustrated in FIGS. 2A and 2B. Previous UCG industrial scale pilots have shown syngas hydrogen content reaching over 70%, and laboratory experiments up to 84%. Methane ($CH_4$), which is another component of the syngas, can be used to produce chemical components.

The last two decades of research dedicated to UCG focused on the reinjection and sequestration of $CO_2$ directly in the cavity formed by UCG [5]. Numerical simulations performed by [5] and dealing with the long-term sequestration of $CO_2$ at about 1 km depth in a commercial-scale post-UCG multi-cavity have demonstrated that injecting and sequestrating $CO_2$ in the UCG cavities is a feasible and viable concept. Other projects have considered coupled CCS but not within the cavity itself.

Another component of the syngas, the CO, can be used for the production of additional commercial products such as methanol, or fertilizer.

Because these components of the syngas can efficiently be used to provide fuel or raw materials for the chemical industry, the UCG process is attractive for the decarbonization of the coal industry.

Another important factor to be considered when implementing the decarbonization of the UCG process is the high temperatures associated with this process. The temperatures of above ground coal gasification typically exceed 1,000° C. Underground combustion temperatures are usually cooler due to groundwater influx but still reach above 600° C. Research on subsurface heat generated in the coal seam and surrounding strata has largely concentrated on the thermodynamic processes and impacts on syngas quality and thermo-mechanics, rather than on utilizing the heat as an energy source. Nevertheless, few studies have forecasted high temperature in the coal seam and in the surrounding strata lasting for a long period of time, as schematically illustrated in the temperature graph shown in FIG. 3, which is taken from [6].

The heat produced by the combustion of the coal represents a huge amount of energy, with temperatures around 600° C. in the cavity. For example, for a medium-volatile bituminous coal with a heating value of 32 MJ/kg, with a seam thickness of 4 m and an area of 1 $km^2$, it is estimated that 5.4 megatonnes of coal are available with a potential total thermal energy of 174.1 Petajoules (assuming a continuous coal seam with a density of 1350 $kg/m^3$). After applying a reduction of 50% for unburnt coal (inaccessible and left for roof support), and a thermal energy to electrical energy capture efficiency even of only 2%, this is equivalent to ~48 GWh or 28,235 Barrels of Oil Equivalent. This amount of energy is sufficient for significant industrial applications.

Considering that this example reflects only a very small portion of the available coal seams that can be targeted for clean, green underground coal gasification, it is evident that a huge amount of energy could be harnessed with minimal emissions. Several technological solutions have been proposed to harvest a part of the heat produced by the combustion process. In this regard, [7] has proposed water circulation in a cooling tube in the production well, with a double end-use: cooling the production well to mitigate the damage due to extreme conditions and harvesting the waste heat. The authors in [8] have proposed to use two sleeve pipe heat-exchange, or a complex heat-gas coproduction equipment [9-10] to extract the heat from the productor well. The authors in [11] have proposed to circulate a fluid between the injection and the production wells to directly harvest the heat through a heat exchanger inserted in the production well. The authors in [12] have proposed a specific device including a coolant conveying pipe to be inserted in the production well to harvest the heat and cool the well. The authors in [13] have proposed a system based on heat conduction pipelines inserted in vertical drillings and connected to a thermoelectric generation system to produce electricity from heat. The authors in [14] rely on an integrated system that is inserted in horizontal wells to ignite the coal, extract the heat and store carbon dioxide.

Others have proposed to use shafts and tunnels in UCG. For example, the authors in [15] have proposed to dig channels for pipelines in the overburden, prior to UCG involving shafts. The authors in [16] have proposed to use solenoids in spirally wound pipe walls. Both methods are adapted to shafted exploitation. Other coal exploitation methods, such as the deep coal in-situ fluidization mining method, or surface coal combustion using a reaction, have been associated with heat extraction. Inter alia, some previous research has focused on extraction of heat from the UCG produced syngas using a heat exchanger system at the surface, as discussed in [17]. Similarly, harnessing waste heat in coking plants has been researched and developed by the authors in [18].

Devices for extracting heat in shallow fired-coal zones (natural or man-made, usually shallow) have been disclosed in [19, 20], and are based on horizontal steel pipes located in the fire area of the coalfield and these pipes introduce a heat carrier for the purpose of extracting thermal energy, or they are based on large vertical casing-type borehole thermal exchanger (up to 30 m diameter) which includes a high thermal conductivity cylindrical housing.

When installed in production wells, the quantity of harvested heat is limited, and the remaining heat in the UCG cavity remains largely unexploited. In addition, devices directly inserted in the coal will encounter extreme conditions that may jeopardize their life length. Other technologies, based on the heat extraction from the overburden by using horizontal wells [21], may breach the confinement of the coal and represent a pollution risk (gas leakage).

Thus, the existing methods are either prone to damaging the used equipment due to the direct heat experienced by the various parts designed to extract the heat or are dangerous for the environment due to the pollution risk. Therefore, there is a need for complementary and adaptable solutions, suitable even for deep coal seams, designed to harvest larger amounts of heat and to limit the risk of damaging the heat extraction devices. In addition, these new methods and systems need to achieve a minimum disturbance to the overburden and to monitor the environment to mitigate the potential environmental impact due to uncontrolled gas leakage and ground movements.

SUMMARY OF THE INVENTION

According to an embodiment, there is a heat extraction system for extracting heat from a reservoir, and the system includes a co-axial tool configured to be placed underground, the co-axial tool having an outer pipe and an inner pipe located within the outer pipe, each of the outer pipe and the inner pipe being connected to a shoe so that a fluid flows through an annulus defined by the inner and outer pipes, reaches the shoe, and flows through a bore of the inner pipe. The system also includes a power generator fluidly connected to a chemical processing unit to receive a fluid, and also fluidly connected with a first port to the inner pipe and with a second port to the outer pipe of the co-axial tool. A temperature difference of the fluid at the power generator and at the co-axial tool drives the power generator to generate energy.

According to another embodiment, there is a method for extracting heat from a reservoir, and the method includes placing one or more co-axial tools underground, the co-axial tool having an outer pipe and an inner pipe located within the outer pipe, each of the outer pipe and the inner pipe being connected to a shoe so that a fluid flows through an annulus of the inner and outer pipes, reaches the shoe, and also flows through a bore of the inner pipe, wherein only the shoe is in contact with a coal seam located underground, fluidly connecting a power generator to a chemical processing unit to receive a fluid, and also fluidly connecting a first port of the power generator to the inner pipe and connecting a second port of the power generator to the outer pipe of the co-axial tool, and generating energy with the power generator based exclusively on a temperature difference of the fluid at the power generator and at the co-axial tool.

According to yet another embodiment, there is a heat extraction system for extracting heat from a reservoir, and the system includes a co-axial tool configured to be placed underground, the co-axial tool having an outer pipe and an inner pipe located within the outer pipe and configured so that a fluid flows through an annulus of the inner and outer pipes, reaches a closed end of the outer pipe, and also flows through a bore of the inner pipe, and a power generator fluidly connected to a chemical processing unit to receive the fluid, and also fluidly connected with a first port to the inner pipe and with a second port to the outer pipe of the co-axial tool. A temperature difference of the fluid at the power generator and at the co-axial tool drives the power generator to generate energy.

According to still another embodiment, there is a method for extracting heat from a reservoir, and the method includes placing one or more co-axial tools underground, the co-axial tool having an outer pipe and an inner pipe located within the outer pipe, and configured so that a fluid flows through an annulus of the inner and outer pipes, reaches a closed end of the outer pipe, and also flows through a bore of the inner pipe, fluidly connecting a power generator to a chemical processing unit to receive the fluid, and also fluidly connecting a first port of the power generator to the inner pipe and connecting a second port of the power generator to the outer pipe of the co-axial tool, and generating energy with the power generator based exclusively on a temperature difference of the fluid at the power generator and at the co-axial tool.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1A:
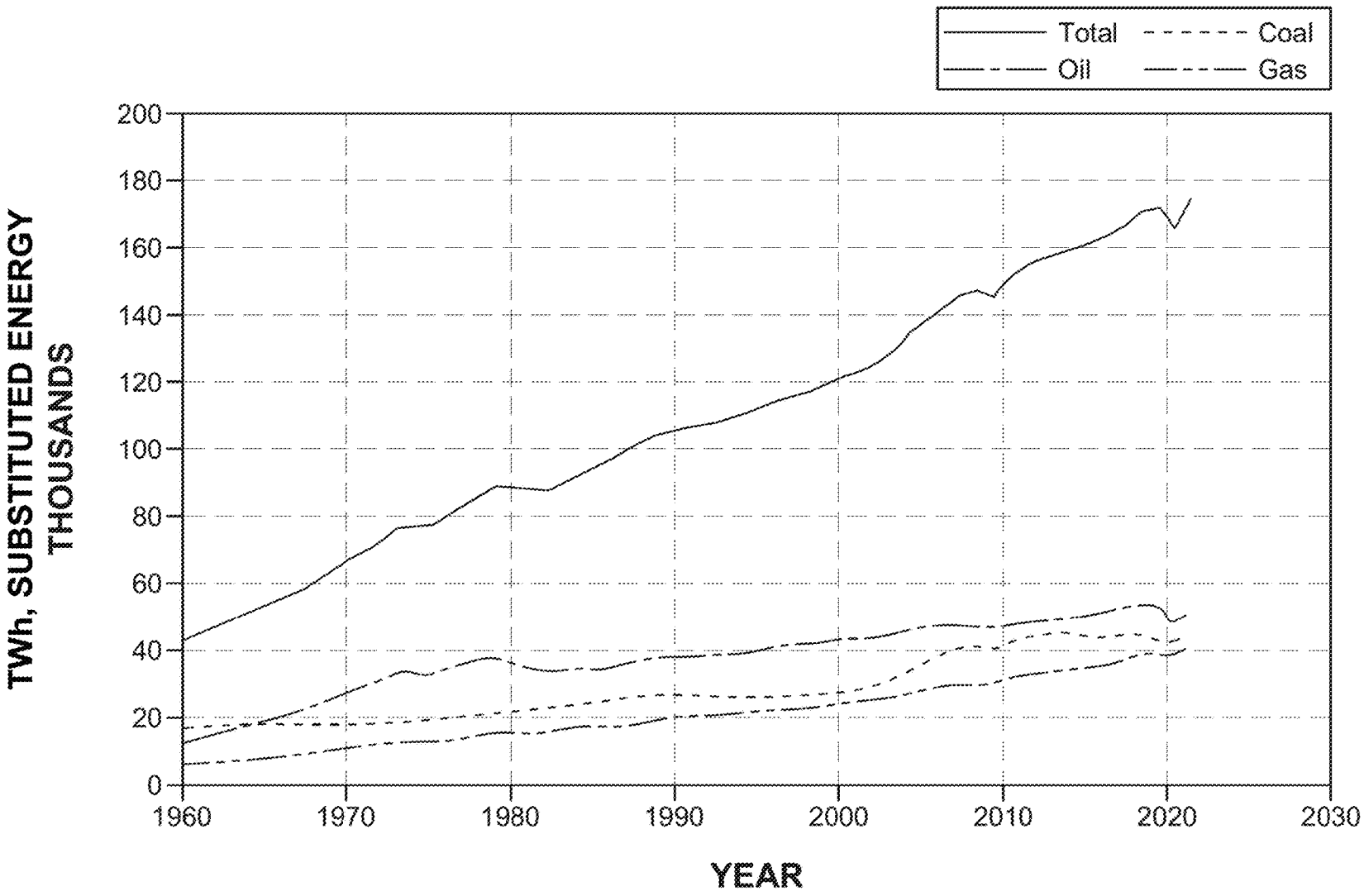
FIGS. 1A and 1B show the worldwide energy consumption and also the source energy ratio in the total consumed energy.
Figure 1B:
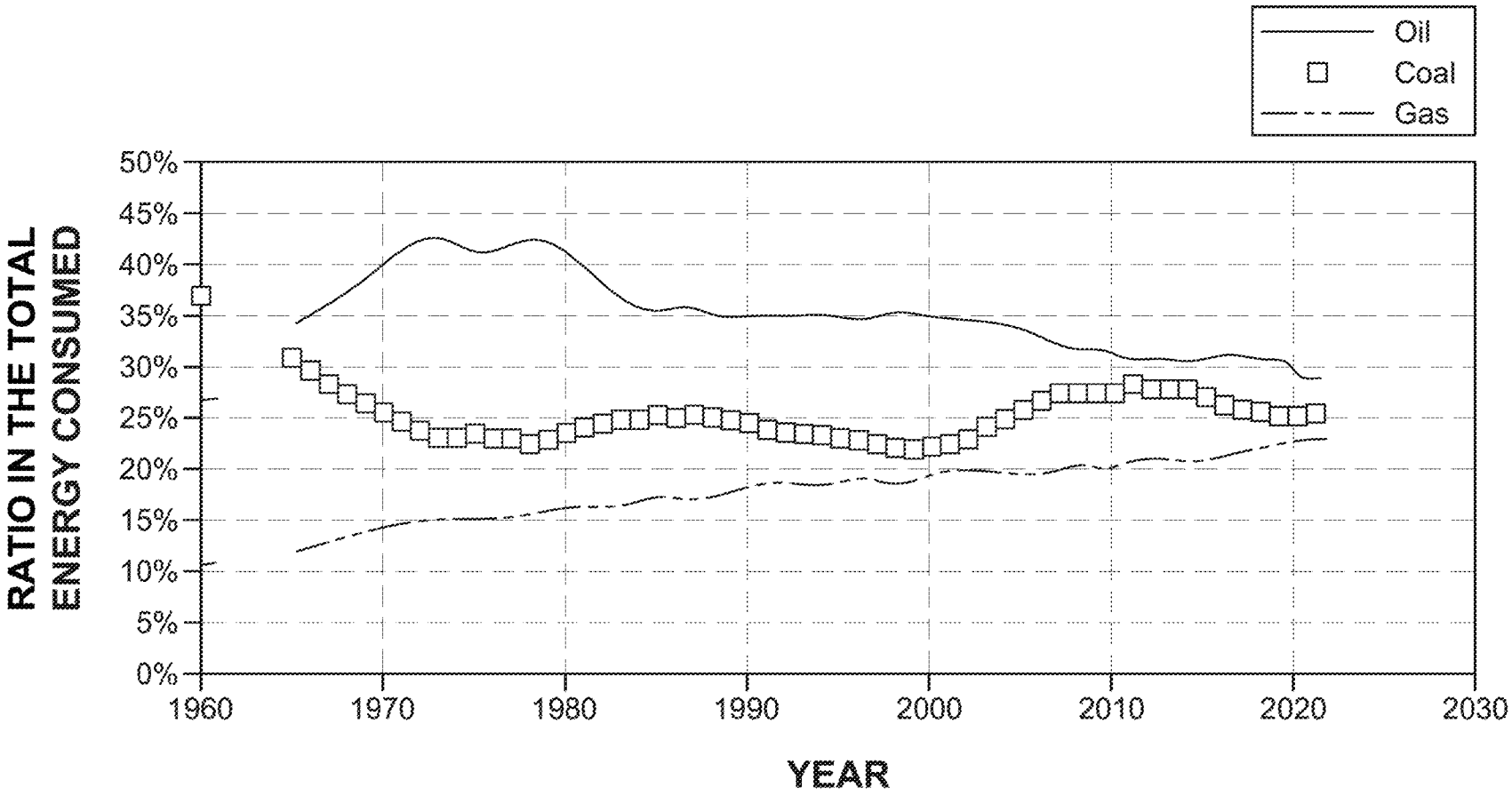
Figure 2A:
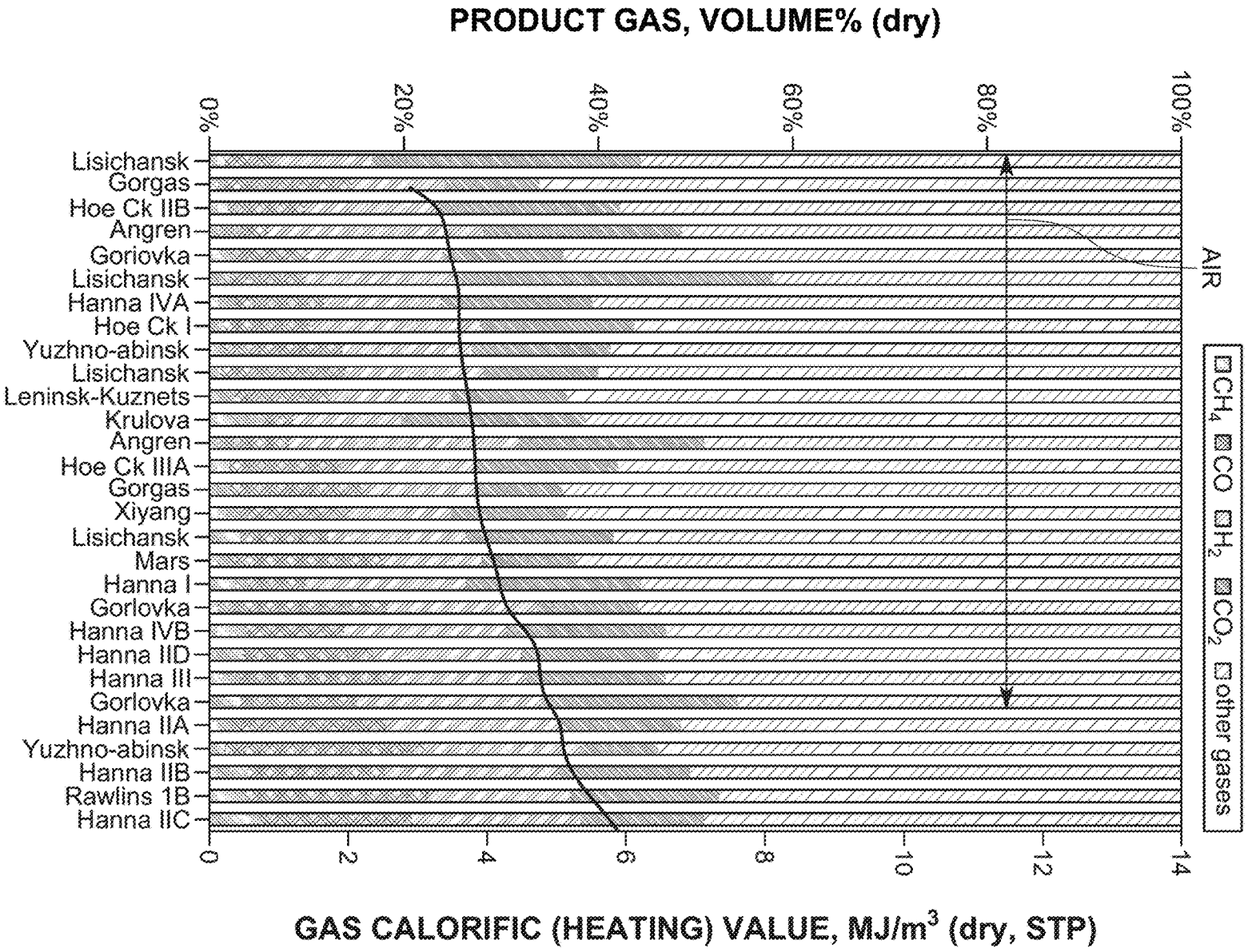
FIGS. 2A and 2B illustrate the syngas composition for different coals using air or oxygen injection conditions for the UCG.
Figure 2B:
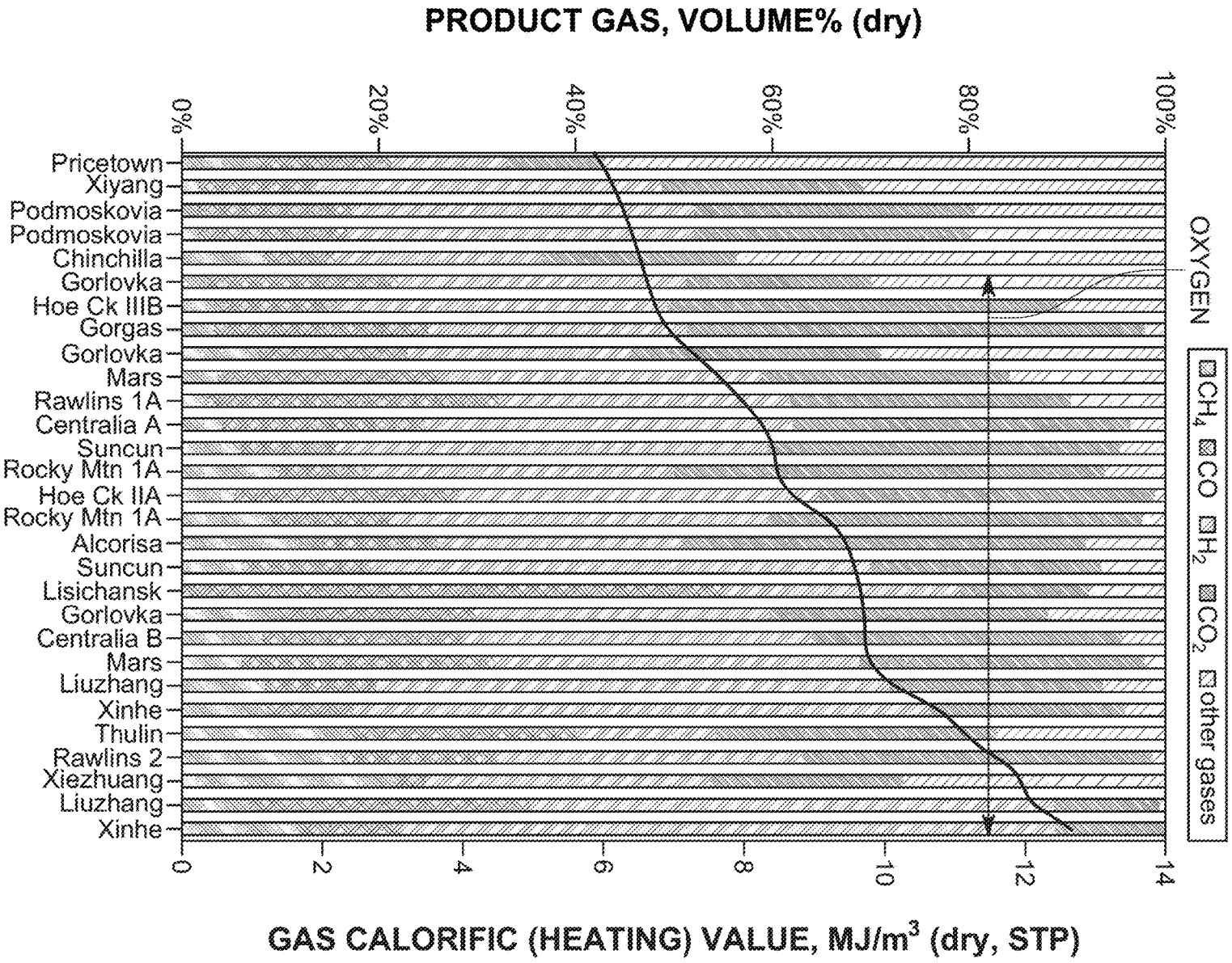
Figure 3:
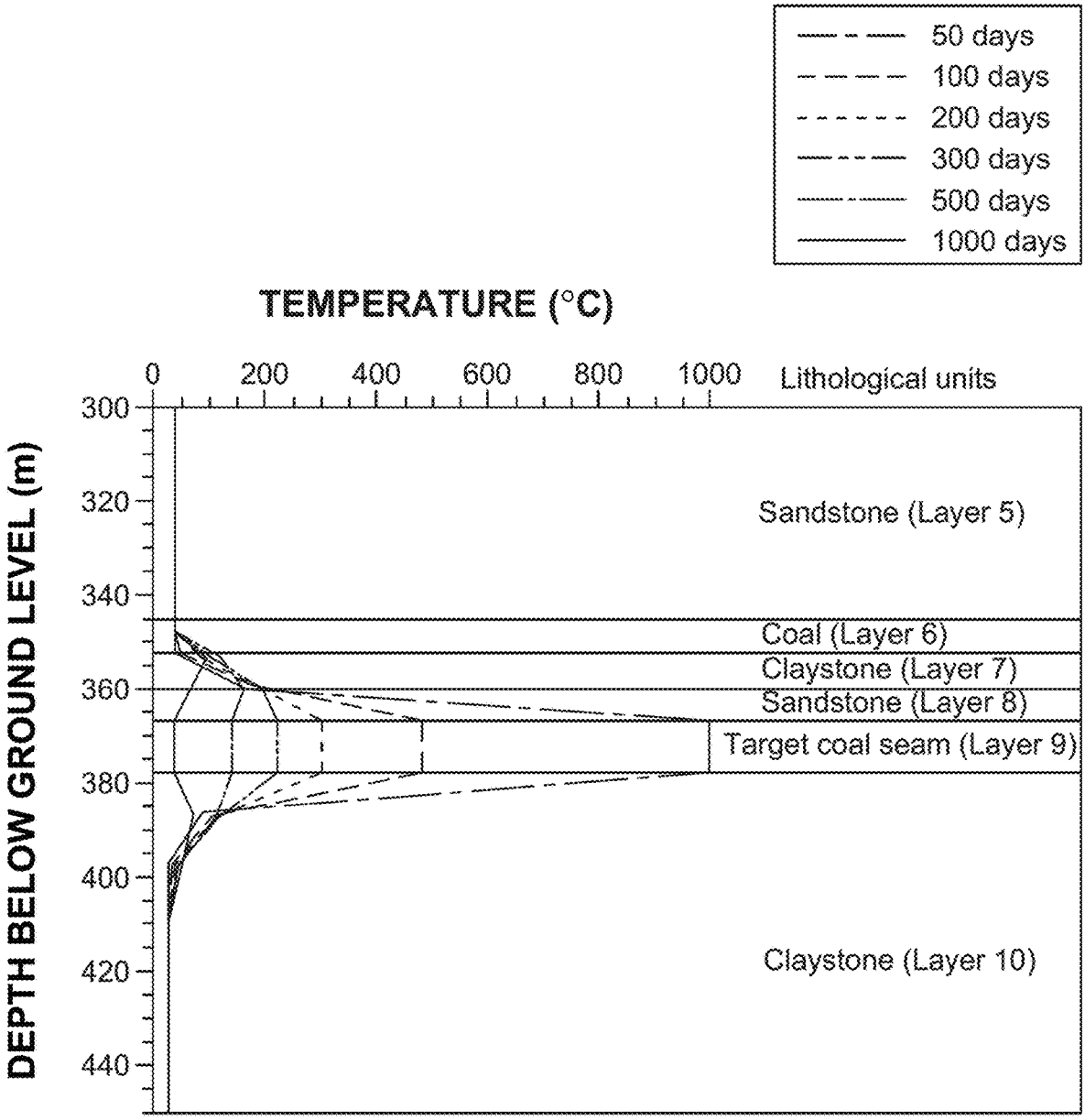
FIG. 3 illustrates a temperature model for a coal seam and other strata in a reservoir at different simulation times.

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a heat harvesting system that includes a co-axial tool provided with an end shoe for entering a high temperature reservoir for harvesting energy. The system can also be configured to extract and/or generate one or more raw materials for chemical plants. However, the embodiments to be discussed next are not limited to the co-axial tool with the end shoe, but may be applied with other tools for extracting the heat, for example, a tool with no end shoe.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a novel system for heat and raw material extraction from an underground coal oxidation process is introduced and this system is configured to reduce the amount of pollution associated with traditional coal exploitation. The system is configured to capture the heat generated during the UCG process with the use of one or more co-axial tools, each having a shoe end, also to capture the syngas generated by the UCG process and to separate from it various raw materials for industrial use, and to incorporate reinjection, recycling and underground sequestration of the Green House Gases (GHGs) in the syngas not used for industrial purposes.

In one application, the system uses complementary and adaptable solutions to produce power from the heat extracted from underground using the co-axial tools (for example, steel shoes of co-axial wells in the cavity, co-axial deviated wells in the underburden or serpentine wells in the underburden). The final products of this system, in one embodiment, are power from the underground heat, and hydrogen from the syngas. Depending on the commercial needs, other raw materials for the chemical industry, such as methanol, can also be extracted. The other syngas constituents will be reinjected into the ground. No GHGs are released to the atmosphere.

The system may be implemented with different configurations. Techno-economic modelling based on thermo-hydraulic simulations allow the definition of the best designs for the system for a given geological context. The designs can be "tuned" to the technology used for the UCG: shaft or shaftless methods, controlled retracting injection point, linked vertical wells, single well integrated flow tubing and methods associated with steeply dipping seams.

The system may include plural co-axial tools that are deployed in wells drilled into the reservoir. In one application, some or all the co-axial tools are driven into the ground without the need of drilling wells. Different patterns may be used for the plural wells/tools to extract the heat, i.e., the number and geographical distribution of the tools over the reservoir may be calculated based on the parameters of the reservoir. Each co-axial tool in the well uses a closed loop working fluid flow (where there is no contact between (1) the rock mass and its components and the coal and (2) the working fluid circulating in the wells). The heat is extracted from the medium by thermal conduction through the wellbore liner/outer pipe or along the stainless-steel shoes at the bottom of the tool. Convection may occur in high permeability zones (cavities, permeable strata and fractures); this enhances the rate of transfer of the extractable heat, and gives better performance of the system.

A range of working fluids can be used in the closed loops of the co-axial tools. However, in one application, super-critical $CO_2$ (S—$CO_2$) is used as the working fluid as it presents several advantages. $CO_2$ is one of the components of the syngas and appears to be a low-cost and a local solution. Supercriticality of the $CO_2$ can be reached above its critical temperature (31° C.) and its critical pressure (7.4 MPa). In addition, S—$CO_2$ is chemically stable and non-flammable. S—$CO_2$ is a promising candidate for high-temperature plant topping cycle to improve thermal efficiency. Indeed, high temperature S—$CO_2$ (>500° C.) presents an excellent system performance (>50% thermal efficiency), in particular when used in Brayton cycles, but also in Rankin cycles, combined gas turbine (CCGT) and super-critical $CO_2$ direct and indirect cycles.

Figure 4:
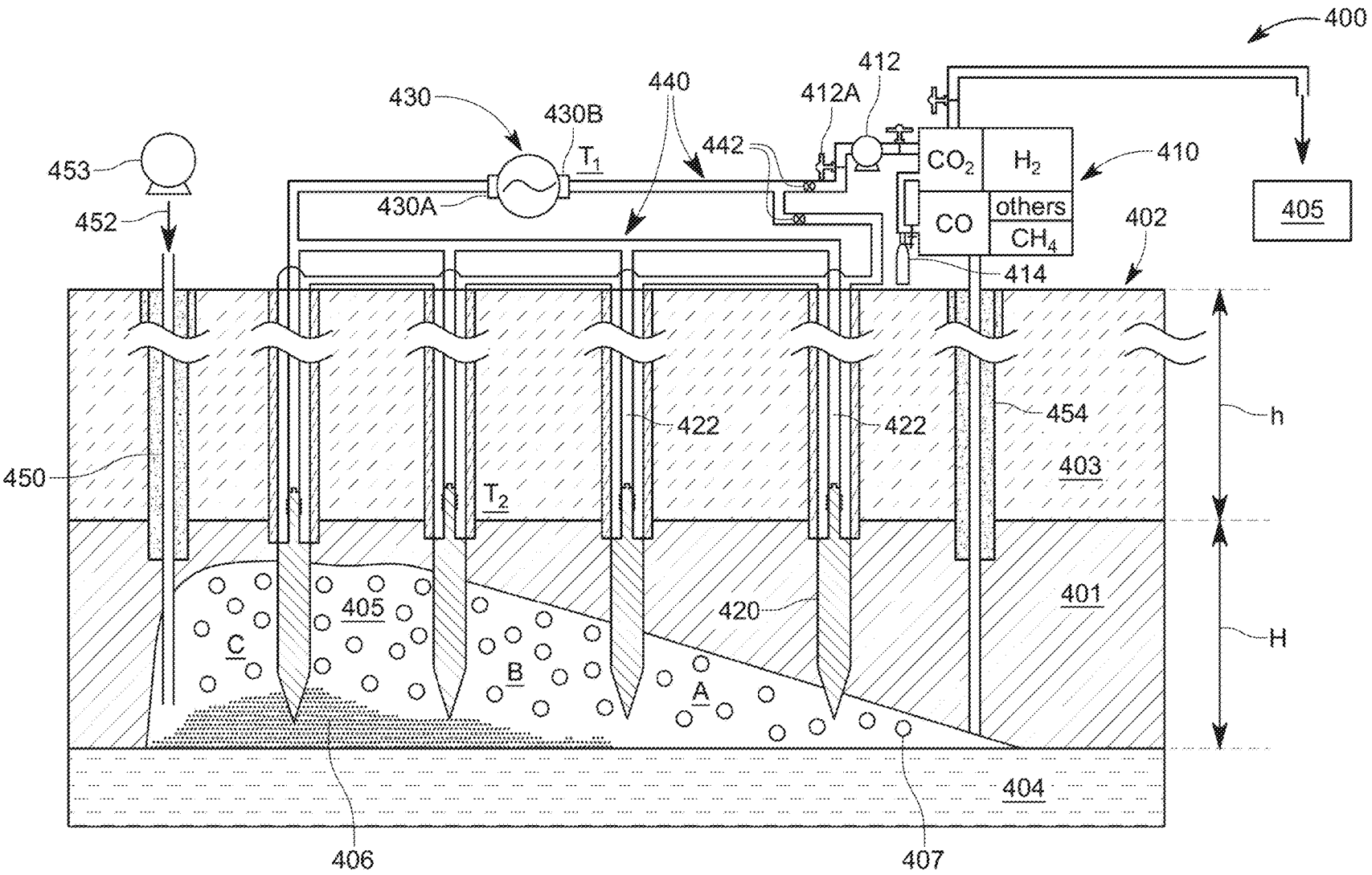
FIG. 4 schematically illustrates a system for extracting heat and resources from a burning coal seam.

Various scenarios for extracting the heat and/or raw material from an underground coal deposit are now discussed with regard to the figures. FIG. 4 illustrates one such scenario in which a system 400 includes a chemical processing unit 410, one or more co-axial tools 420, and a power generator 430. The chemical processing unit 410 is optional as the system 400 can extract heat without such unit. The power generator 430 is fluidly connected, through a pipe system 440 to both the chemical processing unit 410 and to the co-axial tools 420. The power generator may include a turbine, which is actuated by the S—$CO_2$ flow, and an alternator, which is configured to transform into electrical power the mechanical rotation of the turbine. Other devices may be used to harness the heat and/or kinetical energy of the S—$CO_2$ flow, for example, a heat exchanger instead or in addition to the power generator 430. In one application, the power generator 430 is fluidly connected with a first port to an inner pipe of the co-axial tool 420 and with a second port to an annulus formed by the inner pipe and an outer pipe of the co-axial tool 420. The chemical processing unit 410 may include any of the known elements of a chemical plant for separating the syngas into its primary components. The components of the co-axial tool 420 are discussed later.

FIG. 4 shows a coal seam or strata 401 having a thickness H, which is buried a certain distance h under the surface 402. The figure shows an overburden cap 403 and an underburden 404, above and below the coal seam 401, respectively. The figure also shows that part of the coal seam 401 has already burned and a cavity 405 is left behind. The cavity includes some ash 406 and syngas 407. An oxidant injection well 450 is drilled into the coal seam 401, at one side, for feeding air or oxygen 452 for burning the coal. A compressor 453 may be used to pump the air or oxygen 452 into the well 450. A product extraction well 454 is also drilled into the coal seam 401, at another side, away from the oxidant injection well 450, for extracting the syngas 407. The product extraction well 454 is fluidly connected to the chemical processing unit 410.

The chemical processing unit 410 separates the syngas 407 into its various components, for example, $CO_2$, $H_2$, CO, $CH_4$, etc. As noted above, the $CO_2$ may be used as the fluid 422 that flows into the co-axial tool 420. The fluid 422 may be $CO_2$, which is first turned into supercritical $CO_2$, for example, with the help of a compressor 412, and then injected into the piping 440. One way valves 442 may be present in the piping 440 for ensuring that the S—$CO_2$ flows along a desired path, i.e., from the power generator 430 to the inner pipe of the co-axial tools 420, and back to the power generator through the annulus formed by the inner and outer pipes of the tools 420. The direction of this flow can be reversed, i.e., it enters first the annulus, goes all the way into the coal seam, and then goes up through the bore of the inner pipe. In this way, the flow of S—$CO_2$ powers continuously the power generator as long as heat is extracted from the coal seam 401. After the compressor 412 starts the S—$CO_2$ flow, the flow is self-sustained even if the compressor is shut down (valve 412A is closed), as the temperature difference T2−T1 maintains the flow, where T1 is the temperature of the S—$CO_2$ flow at the power generator 430 and T2 is the temperature of the S—$CO_2$ flow at the bottom of the co-axial tool 420. Note that the temperature difference T2−T1 may be about 500° C. or larger.

The produced CO in the chemical processing unit 410 may be treated with oxygen from an oxygen supply 414 to increase the amount of available $CO_2$, such that enough $CO_2$ is pumped through the piping 440 for filling the one or more co-axial tools 420. At the end of the process, i.e., when the coal seam 401 has been all burned, the used $CO_2$ may be injected back into the cavity 405 so that no $CO_2$ is released into the atmosphere. Note that FIG. 4 shows that as the burning of the coal progresses, there are various temperature zones in the cavity 405, for example a drying and pyrolysis zone A, where the temperature is about 200 to 550° C., a reducing zone B, where the temperature is about 550-900° C., and an oxidation zone C, where the temperature is larger than 900° C.

In one application, the co-axial tools 420 are installed prior to the coal combustion and remain in place during the combustion. The shoe of the tool is inserted in the to-be-combusted coal seam as shown in FIG. 4. Depending on the mechanical strength of the coal, the depth, and the technical challenges, a pre-hole can be drilled or, if the coal is soft enough, the shoe can be driven into it. Coring the coal seam prior to gasification presents an opportunity to better understand coal characteristics, including composition, porosity, thermal properties, and other relevant parameters. The enhanced knowledge of the coal properties will provide valuable insights to coal behaviour during the gasification process.

In one application, the wellbore is fully cased and insulated from the overburden rock mass. Cementation is not essential, and depending on the site-specific operational characteristics, the system could be removed after the process, if placed in a proper outer casing (in that case, the outer-casing shoe has to be above the coal seam, as discussed later). The shoe is directly in contact with the to-be-burnt coal. It makes the system more resilient to potential damage due to the ultra-high temperature and to corrosion processes occurring during the burning. The shoe is designed to resist thermo-mechanical strains due to thermal stress, ground movements during the linkage process and when roof spalling occurs. The shoe is made of alloys that must be resistant to high temperature (up to 1,000° C.), corrosive environments, thermal stress, burst strength, and with a sufficient thermal conductivity at the relevant temperatures. At very high temperature, thermal stability is the first factor considered, as this may set limits to a particular type of alloy from the standpoint of softening or, more commonly, embrittlement, and may induce a change in the thermal properties (thermal conductivity in particular). Note that the shoe is allowed to accommodate large deformations as it is not a supporting element but only the heat-transfer tool. Hence, the creep rupture strength at high temperature is the basis for alloy selection.

Figure 5:
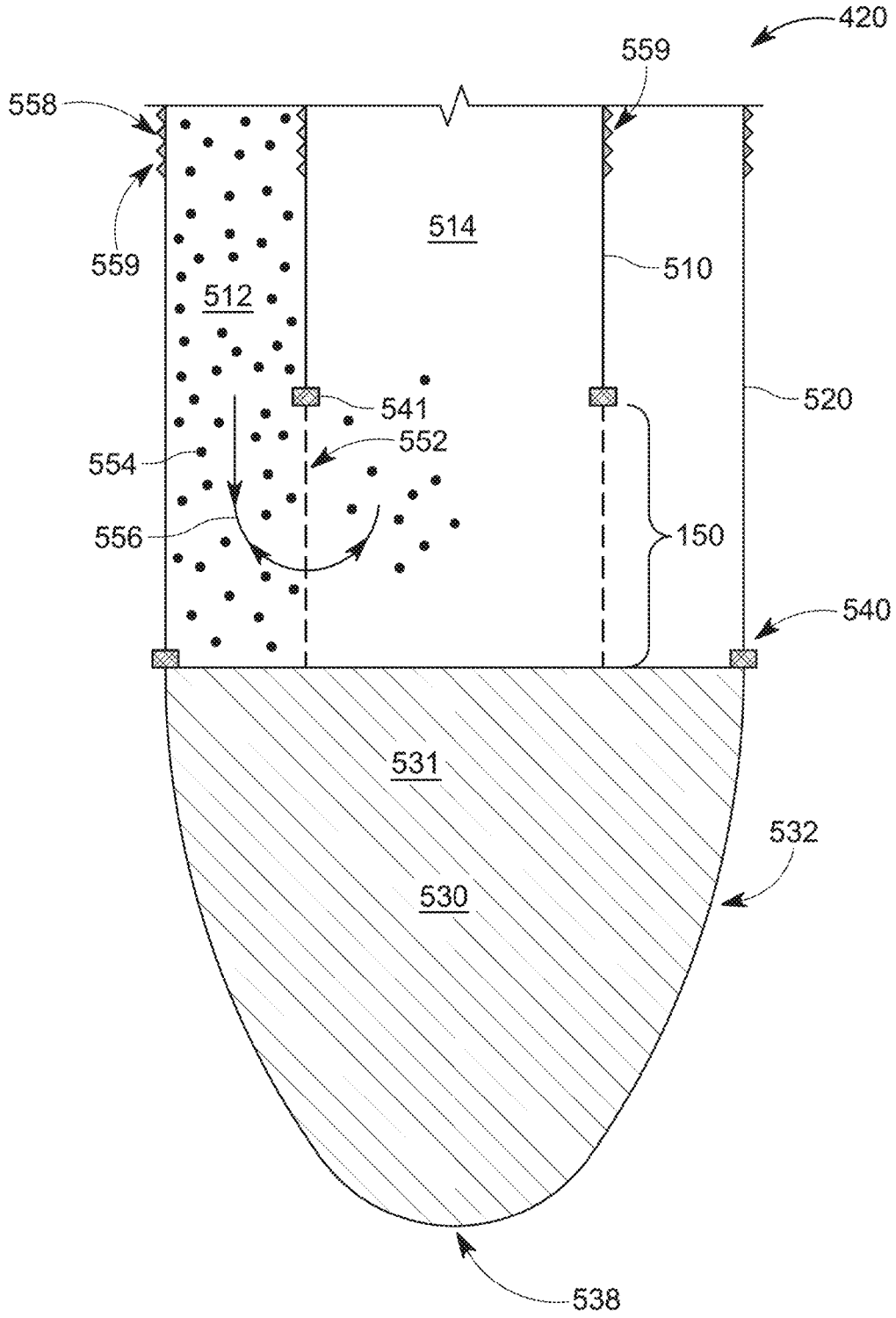
FIG. 5 is a schematic diagram of a heat extraction tool having a shoe for thermally protecting inner and outer pipes.

The co-axial tool 420 is now discussed with regard to FIG. 5. This co-axial tool 420 (also called herein "well tool"

or "tool" or "heat extraction tool") includes an inner pipe 510, an outer pipe 520, concentric to the inner pipe 510, and an end shoe 530. The outer pipe 520 is connected to the shoe 530 through a first flexible coupling 540 while the inner pipe 510 is connected to the shoe 530 through a second flexible coupling 541. A flexible coupling 540/541 is any coupling between two different elements that allow one or both elements to expand due to thermal reasons while maintaining the integrity of the fluid flow through the coupling, i.e., not leaking the fluid. An example of such flexible coupling was introduced in international patent application noted in [22], which is incorporated herein by reference. The flexible coupling 540/541 allows the two connected elements (for example, 510 and 530 or 520 and 530) to achieve a fluid connection that is expandable when the temperature increases, without bucking or leaking the fluid outside.

Figure 6A:
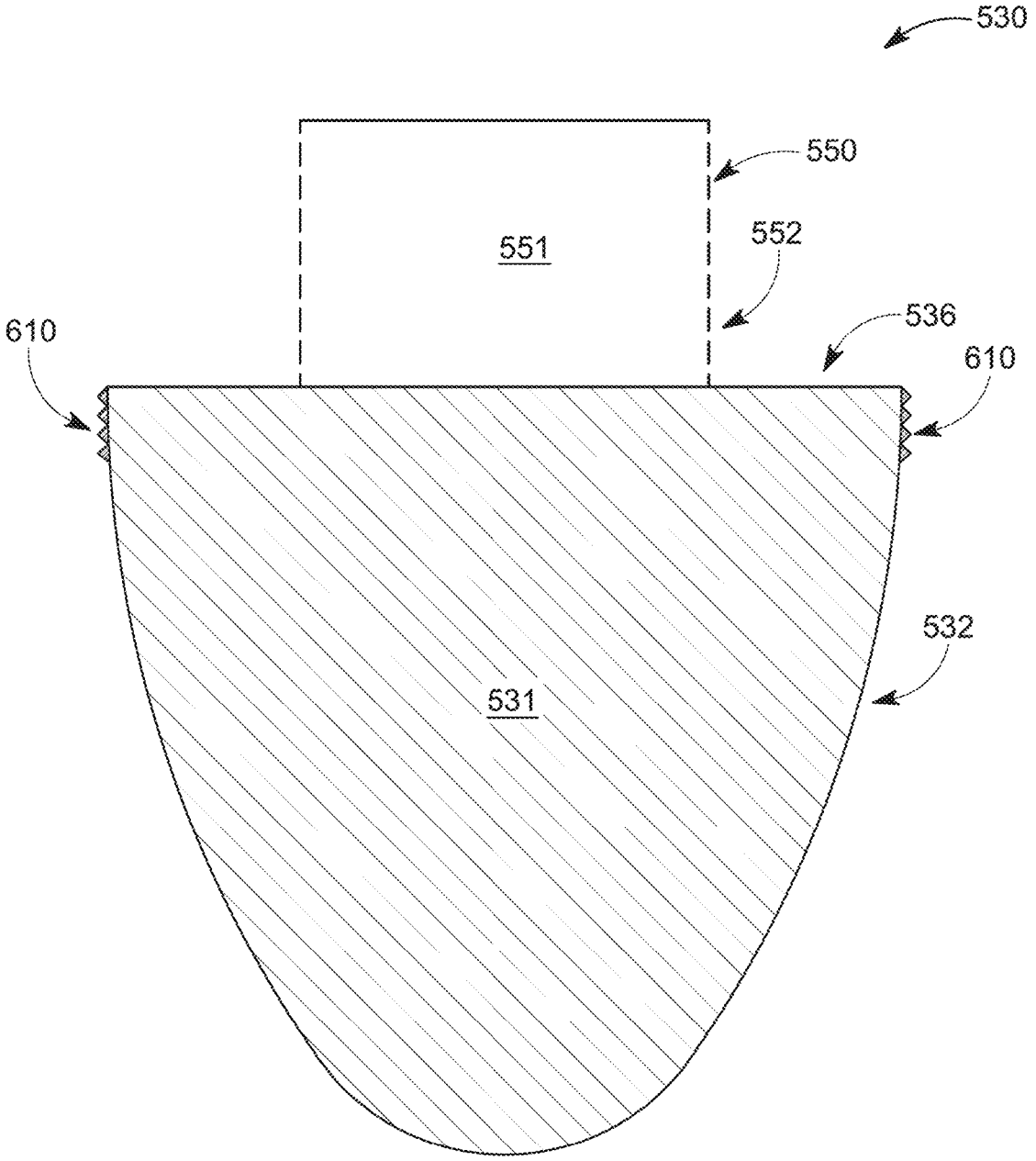
FIG. 6A is a schematic diagram of the shoe of the heat extraction tool having a strainer element and FIG. 6B is a schematic diagram of the shoe without the strainer element.
Figure 6B:
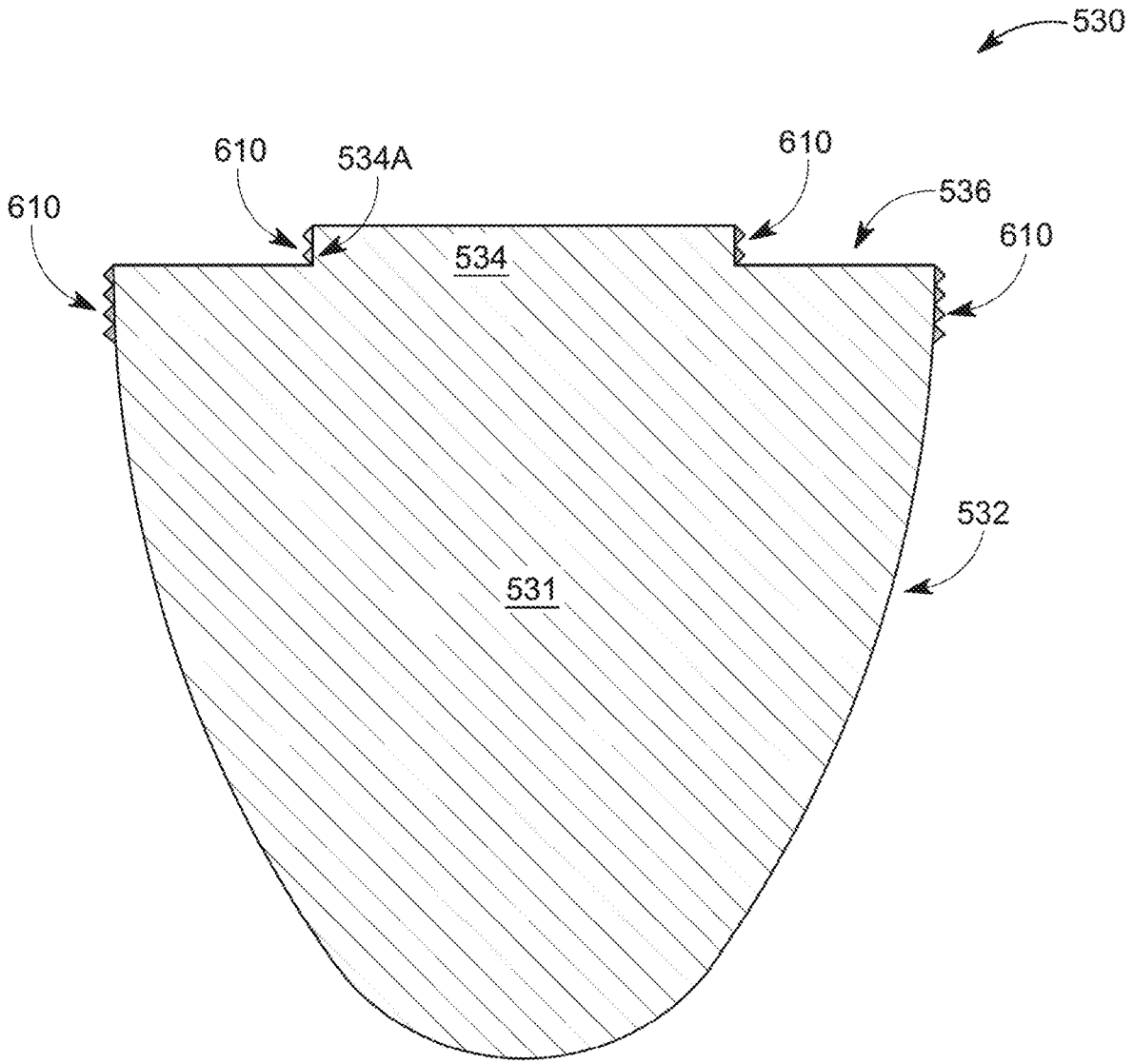

Note that for achieving the connection with the outer pipe 520, in one embodiment, the shoe 530 has threads 610 on an external surface 532, next to the top surface 536, as shown in FIGS. 6A and 6B. For achieving the connection with the inner pipe 510, in the embodiment of FIG. 6A, the shoe 530 also includes a strainer element 550, which is made integrally with the body 531 of the shoe. The strainer element 550 is shaped as a sleeve with an internal bore, and the lateral walls of the sleeve have plural holes 552. For achieving the connection with the inner pipe in the embodiment of FIG. 6B, shoe 530 has a shoulder 534, which is raised from the top surface 536 of the shoe, and threads 610 are formed on the side surface 534A of the shoulder 534, in addition to the threads 610 formed on the external surface 532 of the body 531. Those skilled in the art would understand that this implementation is one of the multiple possible implementations for the flexible coupling 540.

Returning to FIG. 5, the inner pipe 510 may be connected with yet another flexible connection 541 to the strainer element 550, when present. As discussed later, there are embodiments where the strainer element 550 is omitted. The strainer element 550 may be a pipe having the same internal and/or external diameter as the inner pipe 510 and also a plurality of holes 552 for allowing a fluid 554 to leave an annulus 512, formed by the external surface of the inner pipe 510 and the inner surface of the outer pipe 520, and enter the bore 514 of the inner pipe 510. In this way, fluid 554 may be pumped from the surface into the annulus 512, allowed to directly contact shoe 530, and then return to the surface through the bore 514 while carrying the heat transferred from the shoe. Thus, a loop or path 556 is formed from the top of annulus 512, to the shoe 530 and then to the top of the bore 514. In some circumstances, the direction of flow along the loop path may be the reverse of that shown in FIG. 5. Note that a top 558 of the tool 420 corresponds to the part of the tool that is configured to be attached to a casing element before being lowered into the well or driven into the ground. This means that the top part 558 of the tool 420 may have threads 559 for being attached to the casing element. Thus, the inner pipe 510 and the outer pipe 520 are configured to form an uninterrupted loop path 556 for the fluid 554, between a top of the annulus 512 and a top of the bore 514 while also allowing the fluid 554 to directly contact the shoe 530.

In the embodiment shown in FIG. 5, the shoe is made to be solid, i.e., its body 531 has no holes or channels except for the strainer element 550, which has the holes 552. The body and strainer can be made of a single piece of material. The shoe is made of a metal or alloy that can withstand high temperatures (e.g., between 50° and 1200° C.) and/or high pressures, for example, up to 20 MPa. In one application, the shoe is made of tungsten or titanium. In another application, for which the price of the shoe is important to be as low as possible, an alloy with high qualities may be used. For example, stainless steels are the first to be considered, as they offer a good balance between the price and the resistance to extreme environments, in particular alloys usually used for thermal reactors and for combustion chambers, which have a higher tensile strength at high temperature. Alloys including chrome, aluminium, and titanium offer good resistance to extreme conditions (high temperature deformation and corrosion mechanism). Note that as the alloy grade increases, its cost increases.

Figure 7:
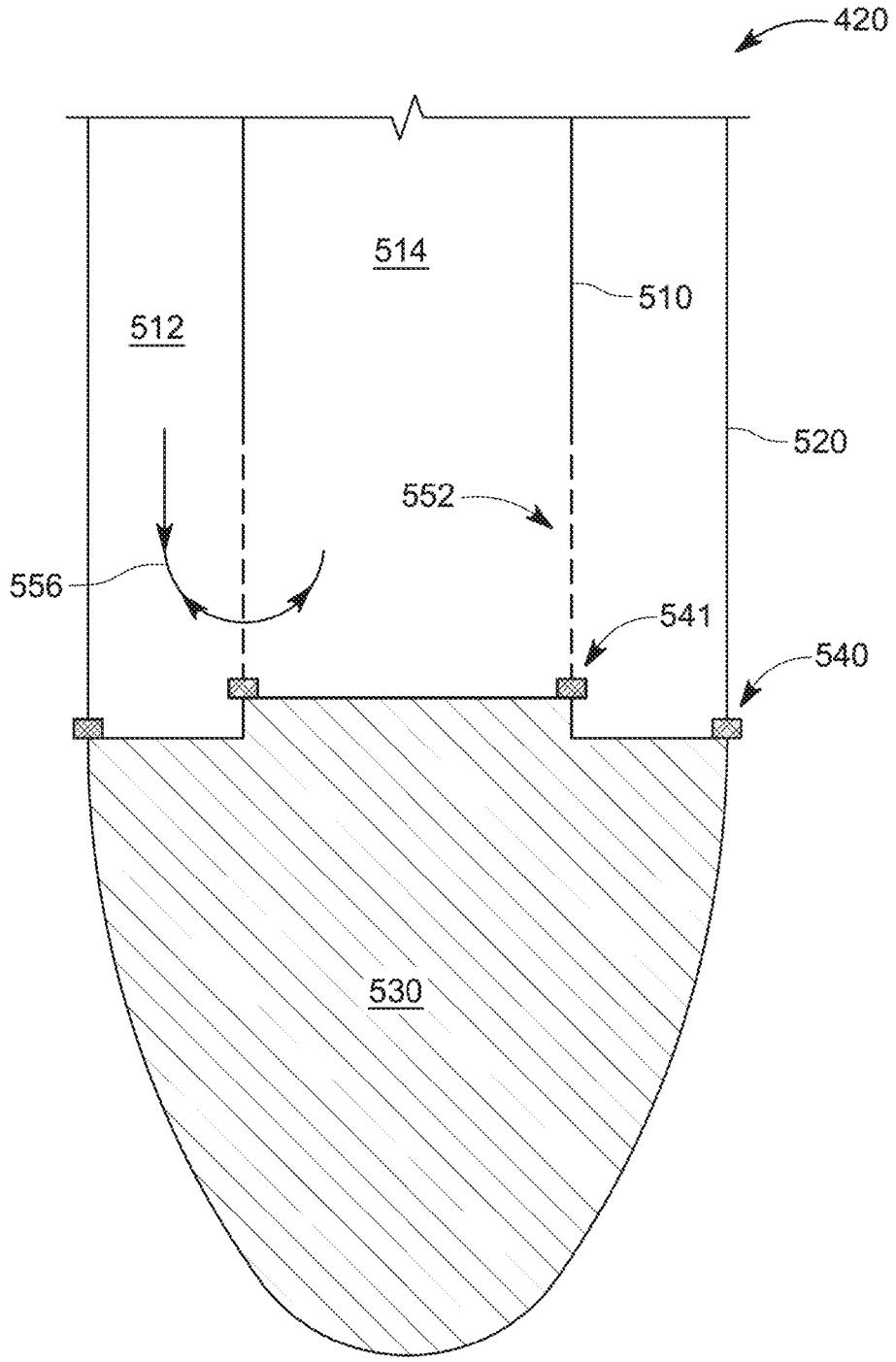
FIG. 7 is a schematic diagram of another heat extraction tool having a shoe for thermally protecting inner and outer pipes.

In another embodiment, as illustrated in FIG. 7, the strainer element 550 may be omitted (i.e., the configuration of the shoe 530 shown in FIG. 6B is used) and the holes 552 may be made directly into the lower part of the inner pipe 510. For this case, the flexible coupling 541 between the inner pipe and the strainer element is not present as the inner pipe couples directly to the shoe 530, with the flexible coupling 541 shown in the figure.

Figure 8:
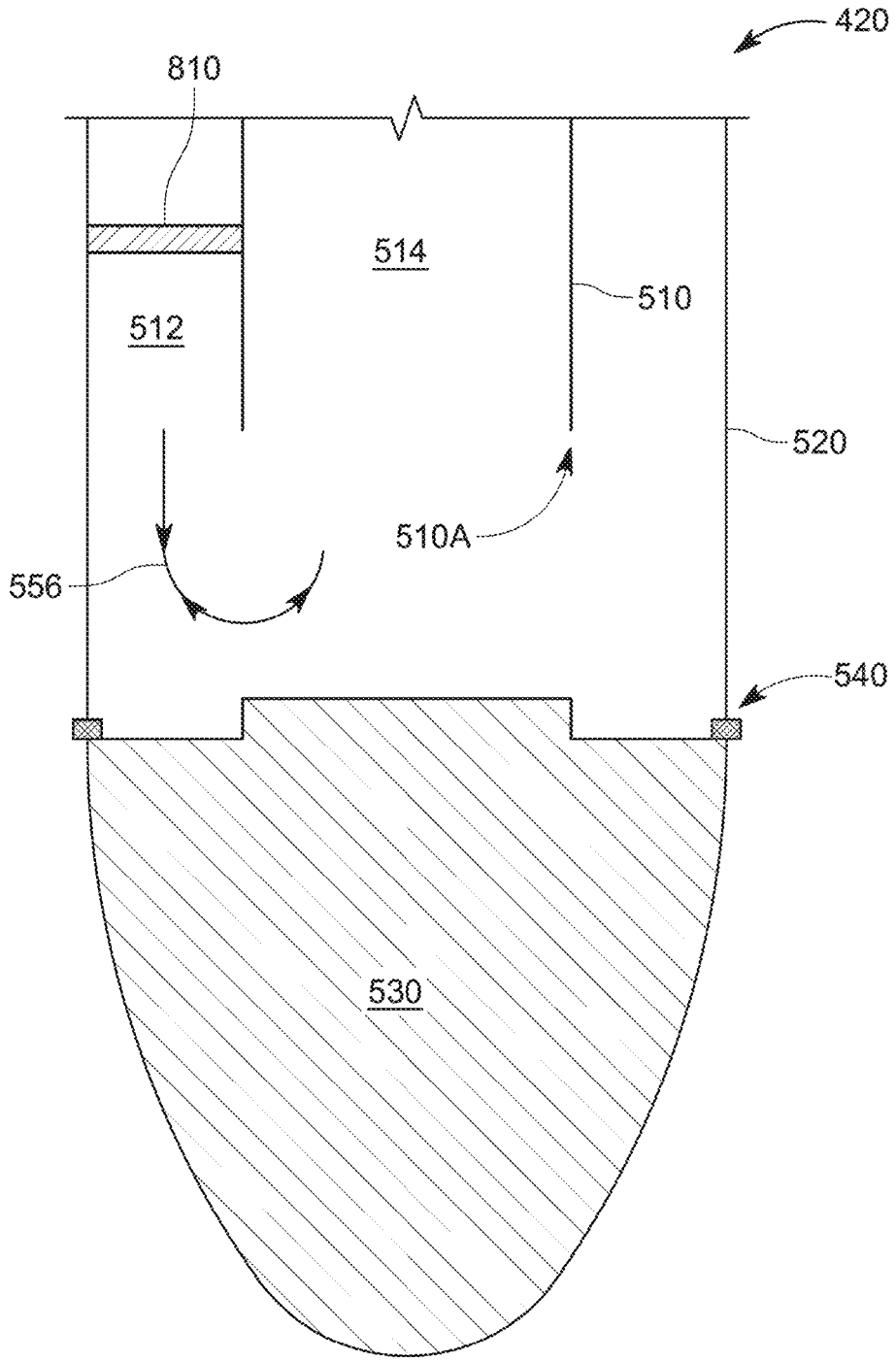
FIG. 8. is a schematic diagram of yet another heat extraction tool having a shoe for thermally protecting inner and outer pipes.

In yet another embodiment, as illustrated in FIG. 8, the inner pipe 510 is fixedly attached to the outer pipe 520 through one or more lugs 810. For this case, the lower end 510A of the inner pipe 510 is located above from the shoe 530, so that the path 556 is free for the fluid 554, from the annulus 512 to the bore 514. In other words, there are no strainer element 550 and no holes 552 associated with the shoe 530 in this embodiment. The lugs 810 may also be used in the previous embodiments, i.e., to fix the inner pipe relative to the outer pipe. However, in the previous embodiments, it is also possible that the inner pipe is independent of the outer pipe, i.e., they do not touch each other through any component, except for the strainer element and/or the shoe.

Figure 9:
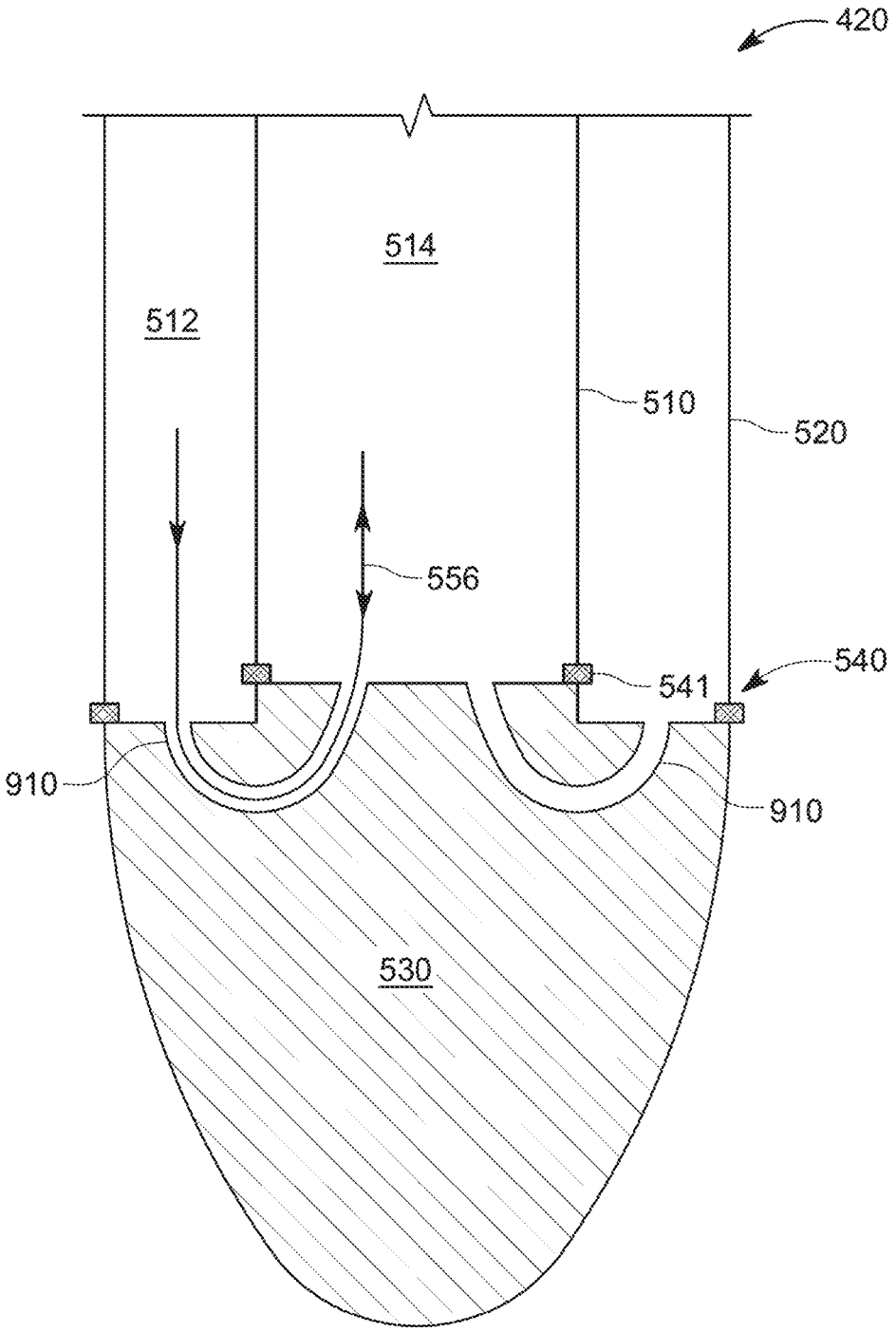
FIG. 9 is a schematic diagram of still another heat extraction tool having a shoe for thermally protecting inner and outer pipes.

In still another embodiment, as illustrated in FIG. 9, the inner pipe 510 directly connects to the shoe 530, for example, through the flexible coupling 541, and no holes 552 are present in the inner pipe. For this embodiment, the configuration of the shoe 530 shown in FIG. 6B is used. Thus, for this embodiment, there is no direct fluid flow from the annulus 512 to the bore 514. For this case, there are plural channels 910 formed through the body of the shoe 530, that fluidly connect the annulus 512 to the bore 514, so that the fluid path 556 still passes from the annulus to the bore, but through the body of the shoe. For this situation, the fluid is expected to remove more heat from the body of the shoe as the fluid effectively enters inside the shoe. While all the above embodiments show a flexible connection 540/541 between the inner and outer pipes and the end shoe, one skilled in the art would understand that nonflexible connections still may be used, even if there are fluid leaks. Note that for all the above embodiments, the shoe includes only a solid body with no other component, i.e., no holes, channels, valves, etc. Only the embodiment of FIG. 9 presents an additional structure, i.e., the channels 910.

With regard to the shape of the shoe 530, the previous embodiments illustrated it as being shaped like a bullet, for example, a largest external diameter matching the external diameter of the outer pipe and then the body having a vertex 538, as shown in FIG. 5. The length of the body (i.e., from the shoulder 534 to the vertex 538) may be selected depending on the width of the reservoir to be explored. In one application, for the embodiment shown in FIG. 5, a length of the strainer element 550 is selected to depend on the diameter of the well in which the tool 420 is placed.

Figure 10A:
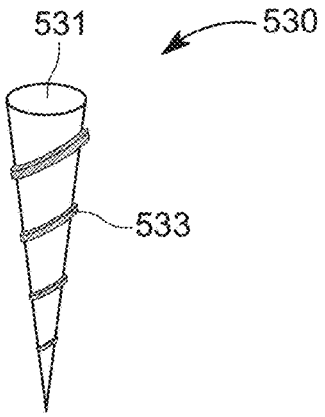
FIGS. 10A to 10C illustrate various shapes of the shoe.
Figure 10B:
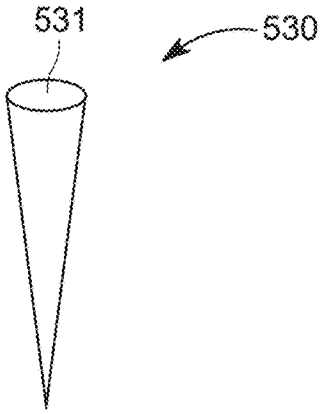
Figure 10C:
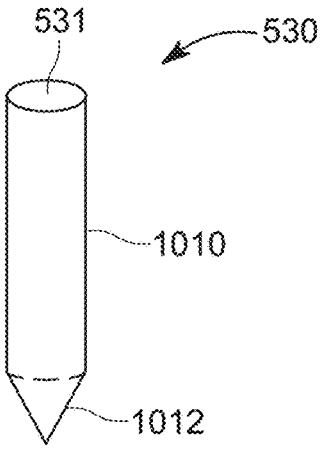

In one application, as shown in FIG. 10A, the body 531 of the shoe 530 has a helix 533 extending along a length of the shoe. The helix may be added or formed into body 531 for promoting the advance of the shoe into the underground when a well is not previously drilled for lowering the tool 420. Note that the tool 420 may be lowered into a pre-drilled well or may be driven into the ground, if the underground is soft. FIG. 10B shows another embodiment in which the shape of shoe 530 is a flat cone. FIG. 10C shows yet another embodiment in which the shape of the shoe 530 is cylindrical 1010 and ends with a pointy shape 1012, for example, a cone. Those skilled in the art would understand that other shapes may be used.

Figure 11C:
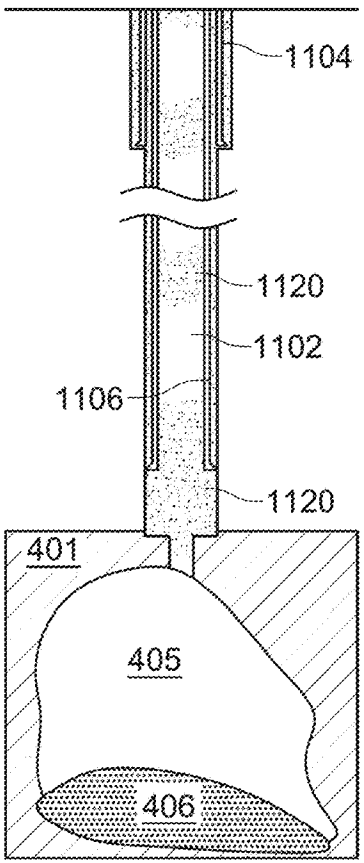
FIG. 11A illustrates the drilling of a well for the heat extraction tool.
FIG. 11B illustrates the placement of the heat extraction tool into the well so that only the shoe enters the burning coal seam, and FIG. 11C illustrate the closing of the well after the heat has been extracted and the heat extraction tool has been removed.
Figure 11B:
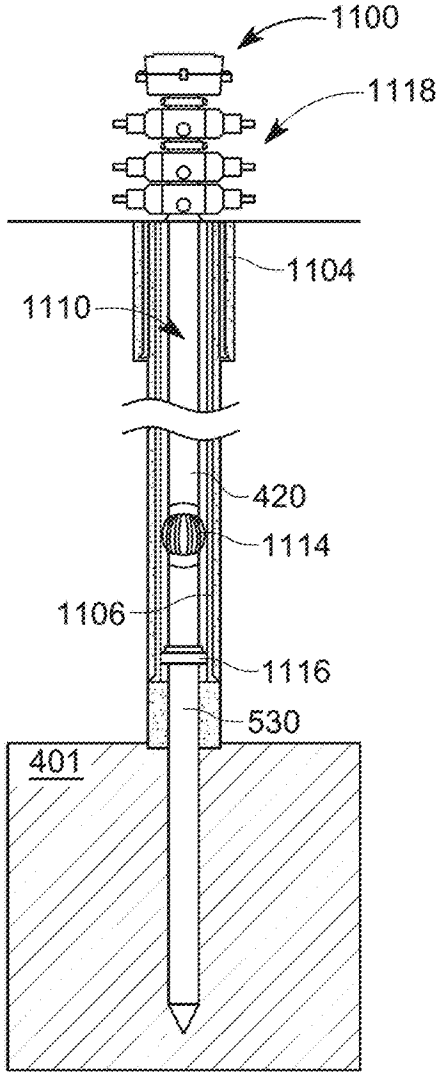
Figure 11A:
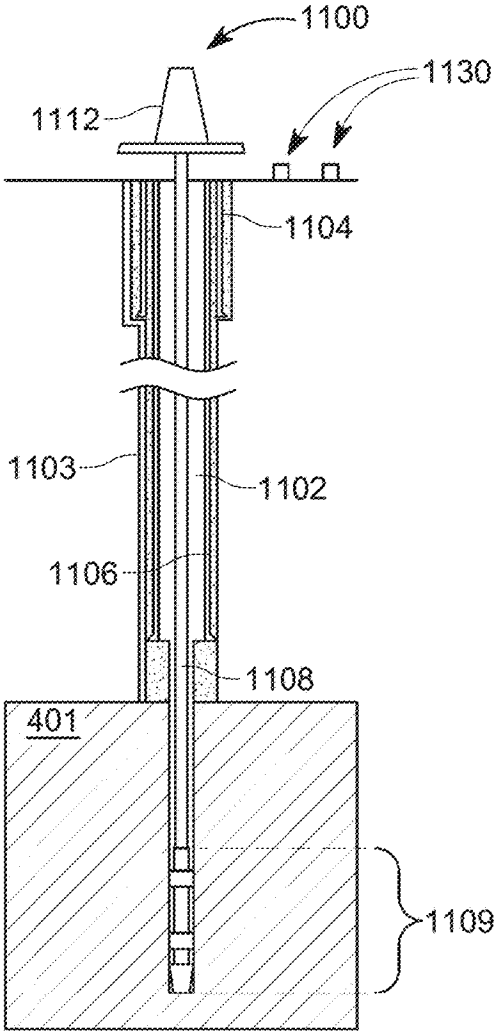
Figure 12:
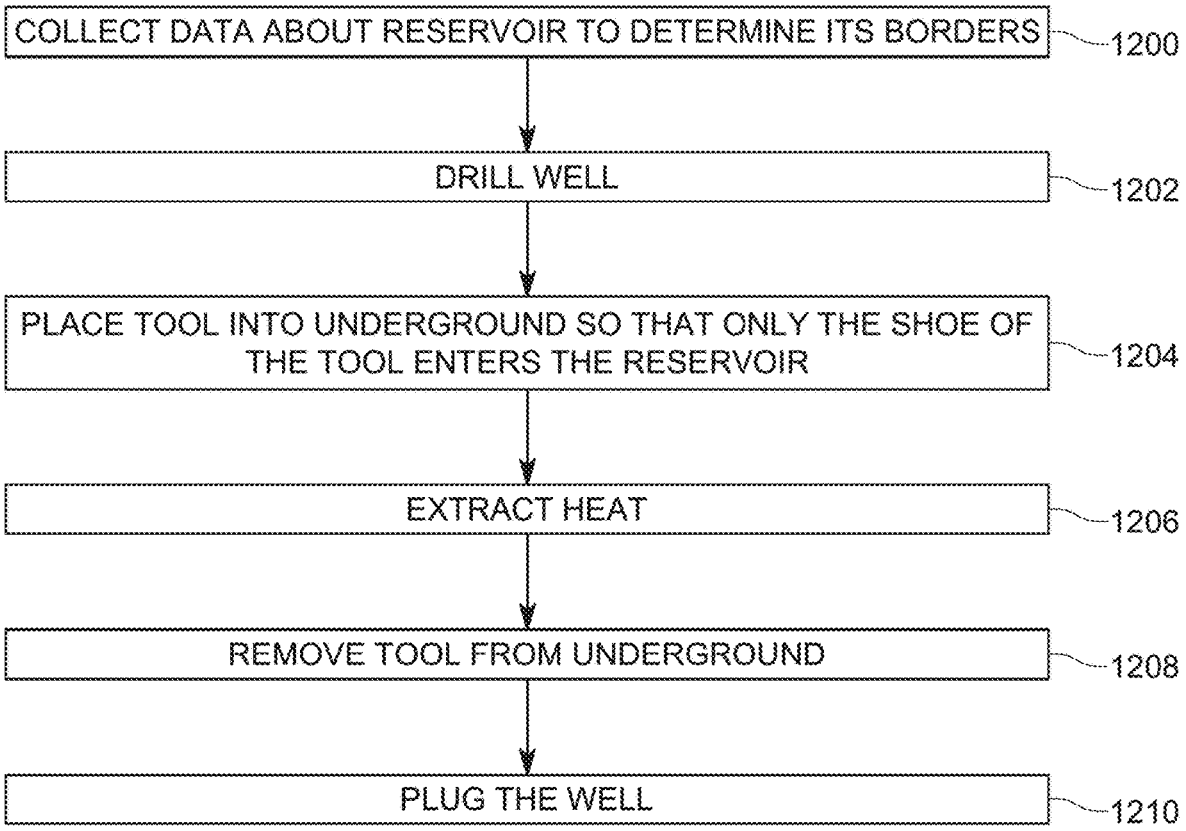
FIG. 12 is a flow chart of a method for extracting heat from an underground reservoir by using a tool having a shoe as illustrated in FIG. 5.

When the tool 420 is desired to be used (as illustrated in FIGS. 11A to 11C), various data (e.g., seismic survey, or information acquired while drilling the well, etc.) is collected in step 1200 (see flow chart of FIG. 12) before lowering (or driving) the tool into the ground. Note that FIGS. 11A to 12 discuss how to use a single tool 420, but the same procedures may be used for the other tools 420 shown in FIG. 4. Based on this collected information, an upper border of the coal seam 401 is determined. In step 1202, a well 1102 is drilled to reach the top of the coal seam, as shown in FIG. 11A, and then, in step 1204, the tool 420 is lowered (or driven if no well is pre-drilled) into the well 1102 until the shoe 530 directly contacts the coal seam. In this embodiment, the shoe alone is directly in contact with the coal seam, but not the inner and outer pipes, as illustrated in FIG. 11B. This makes the system 1100 more resilient to potential damage due to the ultra-high temperature and to corrosion processes occurring in high temperature fluids. The shoe 530 is designed to resist thermo-mechanical strains due to thermal stress, ground movements during the heat extraction process. As discussed above, the shoe may be made of alloys that are resistant to high temperature (up to 1,000° C.), corrosive environments, thermal stress, burst strength, and with a sufficient thermal conductivity at the relevant temperatures. At very high temperatures, the thermal stability is the first factor considered, as this may set limits to a particular type of alloy from the standpoint of softening or embrittlement, and changes in the thermal properties such thermal conductivity with temperature variation. Note that the shoe is allowed to accommodate large deformations as it is not a supporting element for the tool 420, but only a heat-transfer element. In other words, the tool 420 is supported inside the well 1102 by a corresponding casing 1110, which may include plural casing elements connected to each other, as illustrated in FIG. 11B. A casing element may have a length of about 12 m. The tool 420 may have a similar or smaller length. The plural casing elements may be connected to each other by threads, as is known in the art. The tool 420 may be connected with threads to the lower end of the last casing element.

The high thermal conductivity of the alloys at high temperature allows the heat transfer from the metal shoe 530 to the co-axial pipes 510/520. Thermo-hydraulic numerical simulations are run to optimize the design of the tool and the corresponding well (shoe length and diameter, well diameter, number and position of co-axial-well-with-shoe systems).

FIG. 11A shows a surface casing 1104 and a sacrificial casing 1106 installed in well 1102, which is drilled with a drill string 1108. Note that both casings are installed above the coal seam. The drill string 1108 may have a drill tip 1109 for drilling the well 1102. A rotary table 1112 installed at the surface of the well is used for driving the drill tip. When the well is ready, the drill tip 1109 and the drill string 1108 are removed and the tool 420 is lowered into the well, as shown in FIG. 11B. To align the tool 420 with the longitudinal axis of the well 1102, a centralizer 1114 may be installed over the tool 420, as shown in the figure. In one embodiment, to prevent the fluid from the coal seam from entering the casing 1106, a packer 1116 may be installed, for example, just above the shoe 530, as shown in FIG. 11B. For safety issues, to prevent the violent release of the fluid from the well 1102 or the casing 1110 to the surface, a blowout preventer 1118 may be installed on the head of the well. A blowout preventer 1118 is essentially a powerful valve that is configured to close (seal) the well if a pressure inside the well becomes larger than a given pressure. In one application, the annulus between the sacrificial casing 1106 and the co-axial tool 420 is filled by adapted viscous gel that ensures the thermal insulation of the heat extraction tool, while limiting the thermal stress on the sacrificial casing and its cement.

After the heat from the coal seam has been extracted in step 1206, which can take months if not years, just prior to removing the casing 1110 and associated tool 420 from the well in step 1208, it is possible to store $CO_2$ in the cavity 405, and then the well 1102 is sealed with cement plugs 1120 in step 1210, as illustrated in FIG. 11C. In this way, there is little chance that any fluid from the well can escape to the surface after the well is abandoned. Abandonment would occur when, after a certain amount of time depending on the ultra-high heat origin, the heat at the shoe will not be enough to be economically extracted, and the co-axial tool with the shoe might be removed if such a design has been chosen. Abandonment design would consider the predicted effective duration of the heat source, which could be a coal or peat fire, underground coal gasification, or a thin magmatic dike or sill.

Smart and safe implementation of this technology may be matched with monitoring methods, for example, focusing in particular on the temperature, the pressure, and the mechanical behaviour of the tool and of the hosting rock-mass. Additional specific monitoring may be required depending on the nature of the coal seam or of the UCG. For example, distributed acoustic sensing (DAS) systems 1103 cemented behind the sacrificial casing 1106 would allow monitoring of the temperature and the pressure at the interface between the rock-mass and the tool, while DAS fibres inserted in the coaxial tool 420 and fixed to the inner or outer tube give temperature and pressure evolution with the depth in the co-axial loop. In one application, seismic sensors network 1130 at the surface (or buried in noisy environments), as schematically illustrated in FIG. 11A, offer an additional system to detect and locate the potential creation or shearing of faults and fractures due to induced thermal stress. This network can also be used to determine the location of the coal seam and to ensure that only the shoe 530 enters into the coal seam, and not the inner and outer pipes.

By using the novel combination of technologies disclosed here, it is possible to harvest significant quantities of hydrogen from the syngas 407 and heat generated by underground oxidation of coal without releasing harmful emissions to the atmosphere. This opens the door to a greener use of the world's abundant coal resources. The technologies discussed herein can be configured to optimize the capture of heat generated, and then hosted in the rock or in the fluids, during oxidation of coal in the subsurface, for example, by determining how many wells 1102 are necessary for a given coal seam 401, and also the distribution of the wells, and implicit of the tools 420, over the coal seam 401. The amount of captured heat can deliver all the electrical power needed to supply onsite operational needs, including drilling, pumping, measurement, monitoring and validation, plus processing of the hydrogen. This means that these technologies can be applied on a standalone basis and there is no parasitic use of hydrogen for on-site energy needs. The excess power can be used locally for industrial activity or supplied to the grid.

Hydrogen delivery can be optimized to local market conditions, for example, to be delivered by pipeline, compression and cooling for export as liquid, or conversion to ammonia for export as fuel or fertilizer. One or more benefits of one or more embodiments discussed herein for the industries that currently burn coal is that these existing facilities do not need to be closed down, since rapid advances in technology are showing that coal-fired power stations can be converted to burn hydrogen, whilst cement manufacture and steel production can utilize hydrogen and green power.

Figure 13:
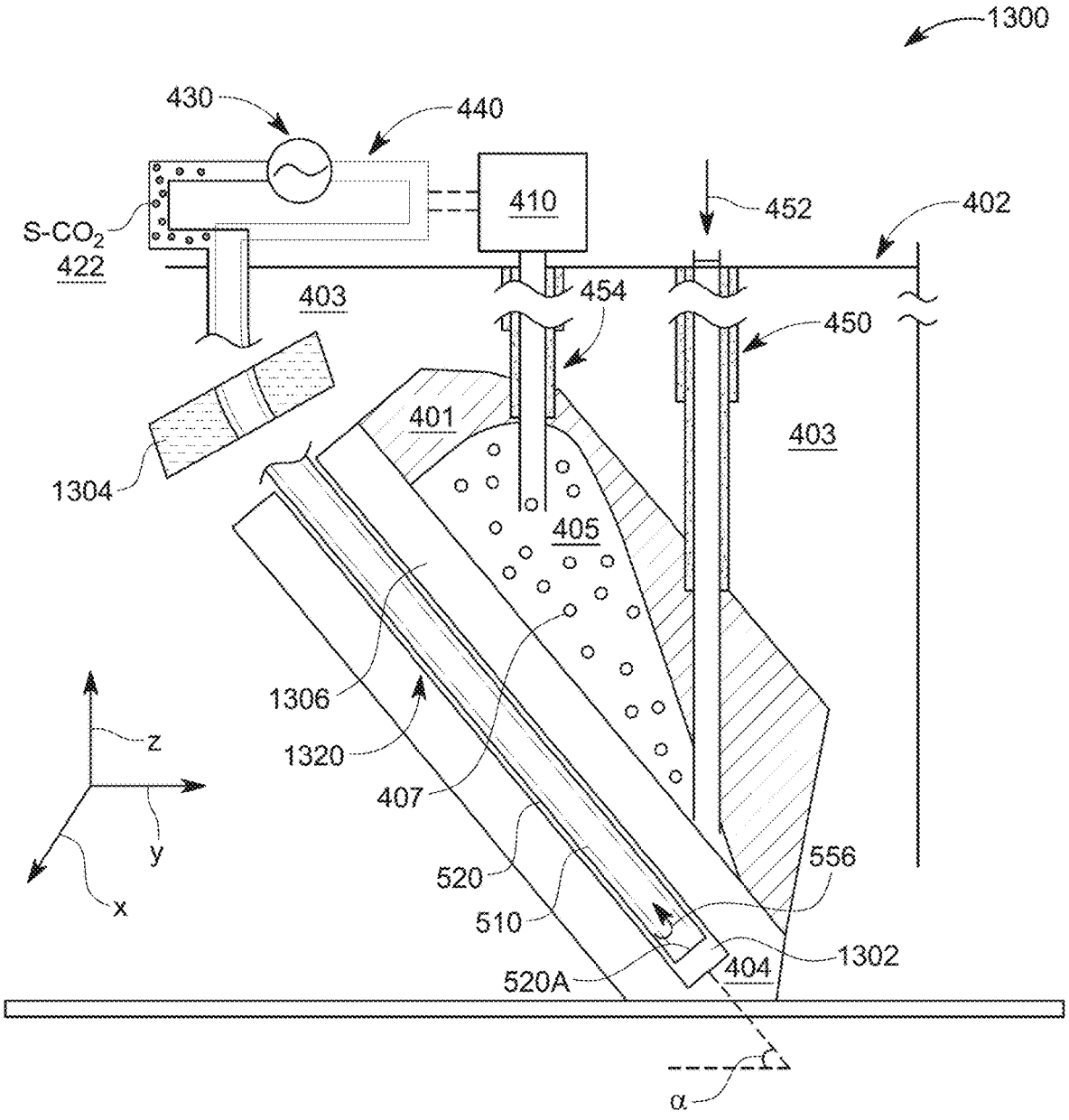
FIG. 13 illustrates a system for extracting heat from a burning coal seam underground with a tool that does not have a shoe.

While the embodiments of FIGS. 4 and 11A to 11C illustrate the process of extracting the heat directly from the coal seam 401, in another embodiment, which is illustrated in FIG. 13, it is possible to extract the heat from the underburden of the coal seam. More specifically, FIG. 13 shows a well 1302 that is drilled under the coal seam 401, at a non-zero angle α made with a horizontal plane XY as the coal seam is dipping. However, this method may also be used when the coal seam is not dipping. In this case, the heat is extracted from layers of material located under the hot burning coal seam and thus, the tool 420 is modified (shown as tool 1320) to not have the shoe 530. Also, the tool 1320 has the distal end 520A of the outer pipe 520 closed so that no fluid from inside the outer or inner pipe communicates with the well 1302. Only the inner pipe 510 and the outer pipe 520 are present in well 1302, and the fluid 422 is circulated from the inner pipe' bore to the annulus of the two pipes, or vice versa. The fluid reaches the bottom of the well 1302 and while flowing through the pipes, it absorbs the pipes' heat. The coal seam 401 is burned with the help of the oxidant 452 injected at the oxidant injection well 450 and the syngas 407 is extracted at the product extraction well 454 and processed in the chemical processing unit 410.

In one application, the well 1302 is drilled prior to gasification. The upper part of the well 1302 may be insulated from the overburden rock using a thermally insulated grout 1304. The bottom of the well 1302, under the future cavity 405, may be cemented using thermally enhanced grout 1306. The working fluid 422, which can be, as discussed above, supercritical $CO_2$ coming from the syngas 407, is injected through the inner pipe 510 and pumped out through the annulus formed between the inner pipe 510 and the outer pipe 520. The trajectory of the lower part of the well (which will harvest the heat) depends on the UCG method. When the gasification involves methods based on vertical wells 450 and 454, deviated co-axial tools 1320 are used for heat extraction as schematically illustrated in FIG. 13. Note that although this figure shows a single deviated well and a single tool 1320, plural deviated wells and plural tools 1320 may be used. The trajectory of the tool 1320 is parallel to the dipping direction of the coal seam 401, under the future cavity 405 created by the UCG process.

Figure 14:
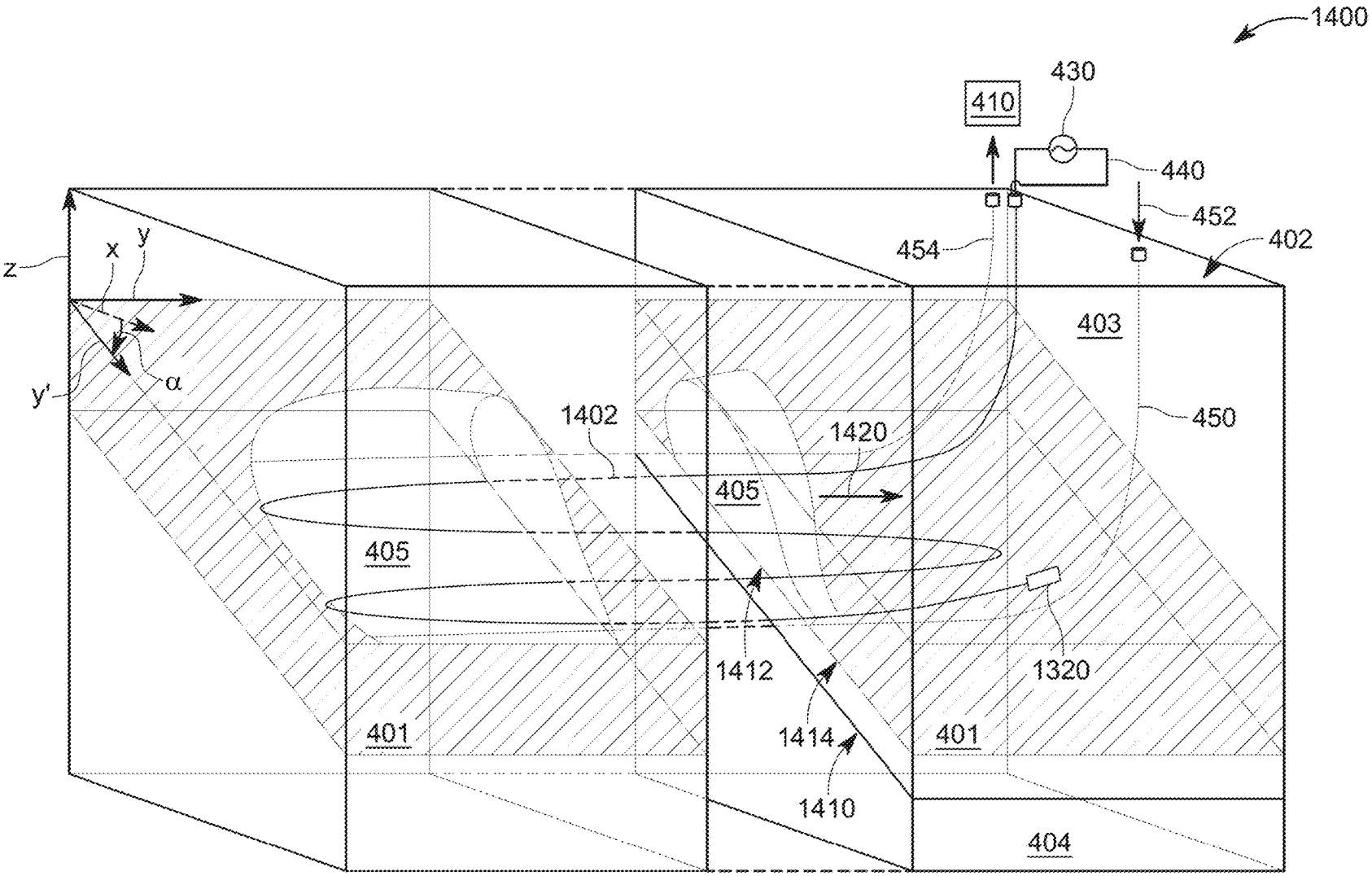
FIG. 14 illustrates another system for extracting heat from a burning coal seam underground with a tool that does not have a shoe.

If the gasification is realized using the CRIP method, another design may be used, for harvesting the heat from a well 1402. In this case, a system 1400 is based on a serpentine trajectory drilled in the underburden 404, in a plane 1410 parallel to the coal seam 401's bottom wall 1412, as shown in FIG. 14. FIG. 14 shows that the coal seam 401 is dipping relative to the horizontal XY plane, with a non-zero angle α, and a cavity 405 is formed within the coal seam due to the burning of the coal. The oxidant injection well 450 and product extraction well 454 deviate from the vertical, as shown in the figure. In one application, all the wells 450, 454 and 1402 are formed in the plane 1410, which extends substantially parallel to the plane 1414, which defines the bottom wall 1412 of the cavity 405. Note that both planes 1410 and 1414 are angularly offset from the XY horizontal plane by the angle α. However, in another embodiment, it is possible that plane 1410 is offset by angle α and plane 1414 is offset by angle α', which is different from angle α. In one application, the horizontal portions of the wells 450, 454, and 1402 are not located in the same plane, but in two or more different planes.

Wells 450 and 454 are shown in FIG. 14 following a curved trajectory, i.e., starting vertically and then slowly turning horizontal, but both follow a straight line along the vertical part and along the horizontal part. However, well 1402 is different, as it forms a serpentine in the plane 1410, i.e., it does not follow a straight line. The shape of the well 1402 may also follow the letter "S" or other curved profiles, for example, the shape of a coil with any number of loops, after departing the vertical direction. In one application, the implementation shown in FIG. 14 is used with the controlled retracting injection point method, which means that the injection point for the fluid 452 is moving along direction 1420 in the figure, which extends the burning zone of the coal seam. For this configuration, the well 1402 is configured to receive a tool 1320, which includes the inner and outer pipes 510 and 520 discussed above with regard to FIG. 5, but with no shoe 530. In other words, the configuration of the tool 1320 in this embodiment may be similar to the one in the embodiment shown in FIG. 13. However, in one implementation, the tool 420 may be used instead of the tool 1320.

Clean and safe implementation of these technologies requires proper risk assessment and mitigation. The following risks in particular must be closely monitored: ground water pollution, gas leakage, and ground movement. Regarding the groundwater pollution, depending on the geological and hydrogeological context, pollutant elements trapped in the combustion ash 406 may be leached by underground water after cavity flooding by groundwater ingress. In one application, risk mitigation is based on keeping the cavity pressure below the surrounding hydrostatic pressure, to help retain contaminated fluid within the cavity. Regarding gas leakage, during and after the coal oxidation, there is a risk of gas release into the overlying strata and into the atmosphere if the cavity is not confined by impermeable overburden, or if discontinuities provide permeable connectivity from the cavity to the overburden and/or to the surface. Thus, these factors should be monitored. Regarding ground movement, depending on the geological context, including the depth and the thickness of the targeted coal seams, subsidence can be encountered. To mitigate this risk, a system of pillars and cavities may be used.

In addition to properly designing the operation to prevent these risks, it is desired to monitor these sites for risk prevention. In one application, it is possible to implement DAS systems, discussed above with regard to FIG. 11A, for example, cemented behind the casing of the different wells (production and injection wells, but also co-axial tools with shoe and co-axial serpentines). These systems allow monitoring of the temperature—to monitor and control the heat extraction, the pressure—to maintain the cavity depressurized relative to the surrounding aquifers, the seismicity—that can indicate the creation or shearing of faults and fractures, which can be pathway for gas leakage.

Further, it is possible to use a seismic sensors network (see network 1130 in FIG. 11A) at the surface (buried if noisy environments), as an additional system to detect and locate the creation or shearing of faults and fractures. Other possible risk prevention methods include time-lapse gravity and electromagnetic (EM) surveys to "visualize" the cavity locations and size in the ground. Depending on the geological context, methods with an active source such as CSEM (Controlled-source EM) can give good reproducibility, permitting measurement of the evolution of the cavity through time, and/or interferometric synthetic aperture radar (INSAR) and other geodesic sensors to monitor the ground movement.

Figure 15:
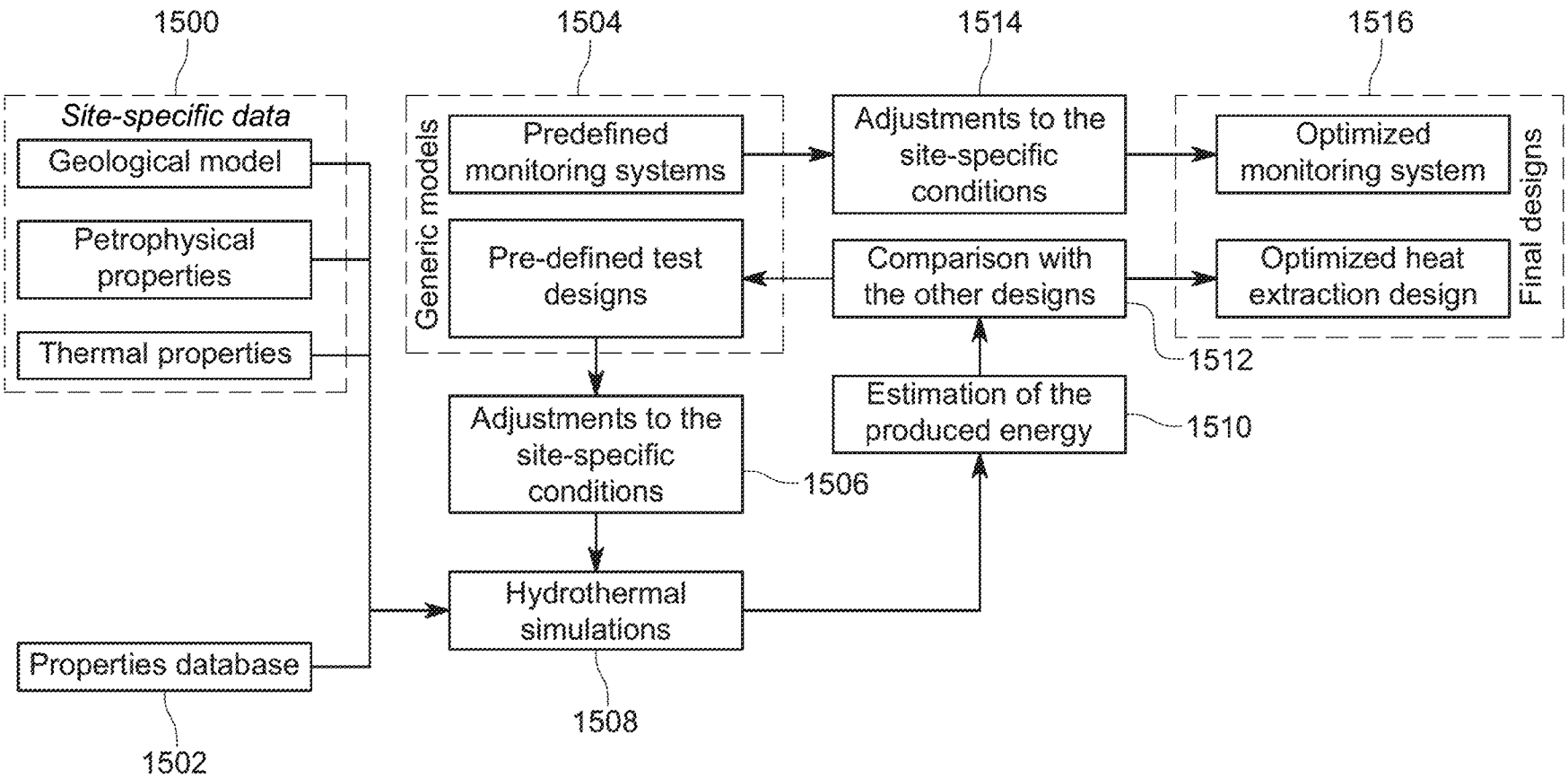
FIG. 15 is a flow chart of a method for determining a configuration to be used for extracting heat from an underground reservoir.

A methodology to optimize the design of the heat extraction and monitoring systems is now discussed. The optimization of the heat extraction design is based on hydrothermal numerical simulations including site-specific data and using generic designs to be adjusted to the context in order to fast-track the workflow. A monitoring design is included in the workflow illustrated in FIG. 15. The method includes a step 1500 of receiving site-specific data, for example, one or more of a geological model, petrochemical properties, thermal properties, etc. Additional data may be stored in step 1502 in a properties database, for example, coal related properties, burning rates, oxygen amounts, etc. Missing parameters in the various models are filled with the data from the properties database. In step 1504, one or more generic models, for example, monitoring system, test designs, are input to the system by the operator of the coal seam. Adjustment to the site-specific conditions may be performed in step 1506 based on the practical conditions at the site, for example, geometry, geology, UCG design if predefined, petrophysical and thermal properties if available. In step 1508, various hydrothermal simulations are performed for the site based on the input data. Estimation of the produced energy is calculated in step 1510, for example, based on the number of wells for the tools 420, the materials used for the tools 420, the depth of the tools, etc. In step 1512, the results of these simulations are compared with other designs received in step 1504, and adjustments to the site-specific conditions are made in step 1514. Finally, in step 1516, the monitoring system and the extraction design are optimized and a final design is generated.

The simulations noted above may be run using a hydrothermal fully coupled software multiphase (liquid and gaseous phases) flow model as very high temperatures are involved. Fluid can flow in the rock matrix, in the faults/fractures if any, and in the cavity. The predefined generic models received in step 1504 may involve a generic geology (both horizontal and dipping coal seams) at an appropriate depth (such as 1 km) and generic petrophysical and thermal properties based on the data ranges available in the associated database.

The technologies discussed above may be implemented as various methods in the field. For simplicity, only two such methods are discussed herein, but one skilled in the art would understand that variations of these methods are possible. The configuration shown in FIG. 4 is first discussed. This configuration may be used to generate electrical power at the power generator 430, based exclusively on the temperature difference of the fluid 422 at the shoe 530 (temperature T2) and at the power generator 430 (temperature T1, smaller than T2).

Figure 16:
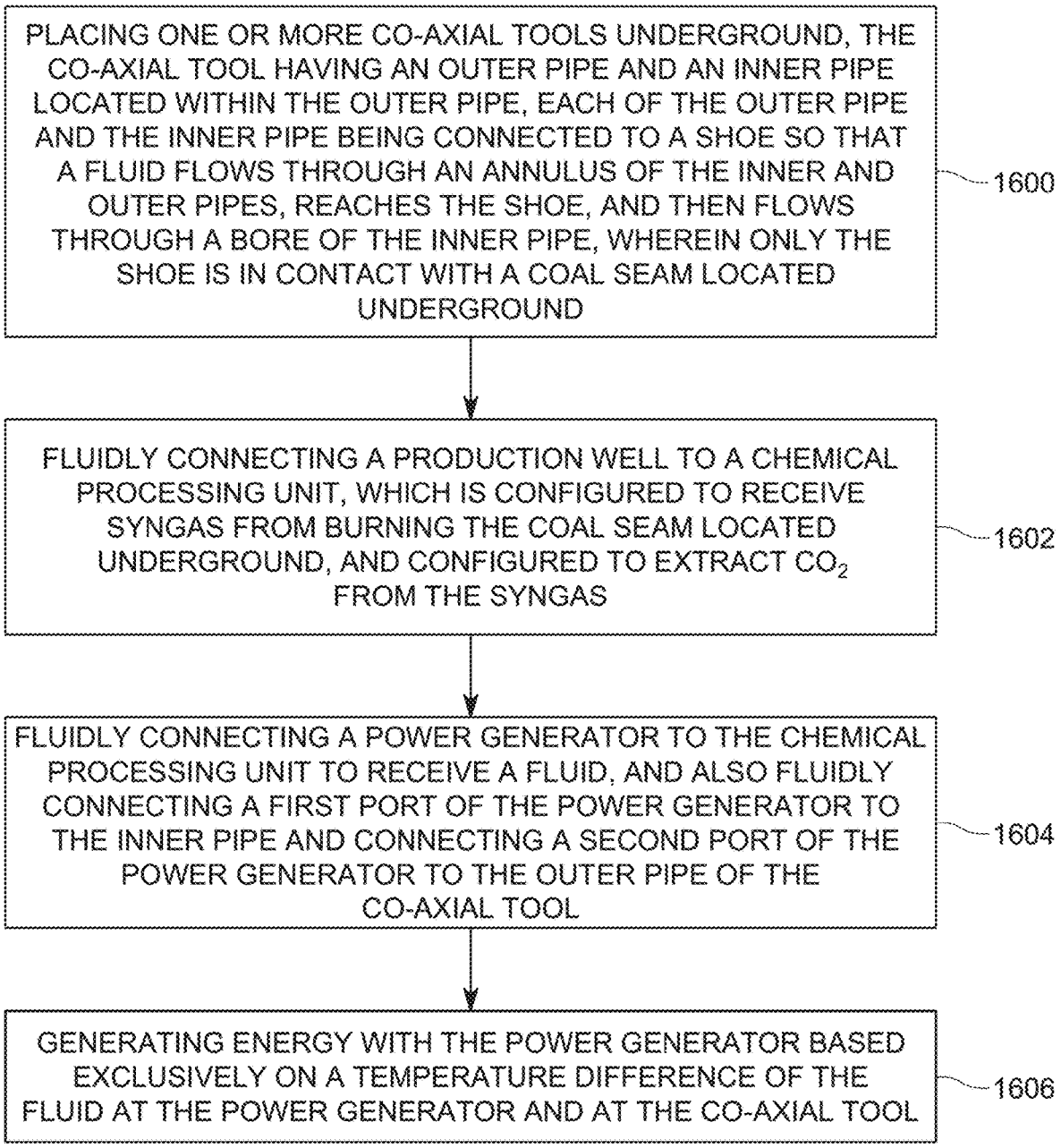
FIG. 16 is a flow chart of a method for extracting heat from a burning coal underground reservoir by using a tool having a shoe as illustrated in any of FIGS. 5 to 9.

More specifically, a method for extracting heat from a reservoir 401 includes, as schematically illustrated in FIG. 16, a step 1600 of placing one or more co-axial tools 420 underground, the co-axial tool 420 having an outer pipe 520 and an inner pipe 510 located within the outer pipe 520. Each of the outer pipe 520 and the inner pipe 510 is connected to a shoe 530 so that a fluid flows through an annulus 512 of the inner and outer pipes, reaches the shoe 530, and then flows through a bore 514 of the inner pipe 510, where only the shoe 530 is in contact with a coal seam 401 located underground. Note that the flow may be reversed, i.e., the fluid flows first through the bore 514, contacts the shoe 530, and then flows up the annulus 512.

In step 1602, which is optional, the production well 454 is fluidly connected to a chemical processing unit 410, which is configured to receive syngas 407 from burning the coal seam located underground and is also configured to extract $CO_2$ from the syngas 407. Note that the chemical processing unit may be refinery, a chemical plant, etc. In step 1604, a power generator 430 is fluidly connected to the chemical processing unit 410 to receive the fluid 422. The power generator is also fluidly connected, with a first port, to the inner pipe 510 and with a second port 430B to the outer pipe 520 of the co-axial tool 420. In step 1606, the power generator generates electrical energy, based exclusively on a temperature difference of the fluid 422 at the power generator 430 and at the co-axial tool 420.

The method may also include a step of separating $CO_2$ from the syngas in the chemical processing unit, and a step of compressing the $CO_2$ to make supercritical $CO_2$ to be used as the fluid. The method may further include a step of circulating the supercritical $CO_2$ through the annulus and the bore of the co-axial tool to reach the shoe and extract heat from the burning coal seam, and a step of circulating the heated supercritical $CO_2$ through the power generator to produce electrical energy. Optionally, the method may include a step of injecting air or oxygen into the coal seam for sustaining the burning, and/or a step of extracting $H_2$ from the syngas with the chemical processing unit. When the process is considered to not be any more economically viable, the method may include the step of injecting the supercritical $CO_2$ into a cavity formed in place of the burned coal seam, and sealing wells connected to the cavity for storing the $CO_2$ underground.

Figure 17:
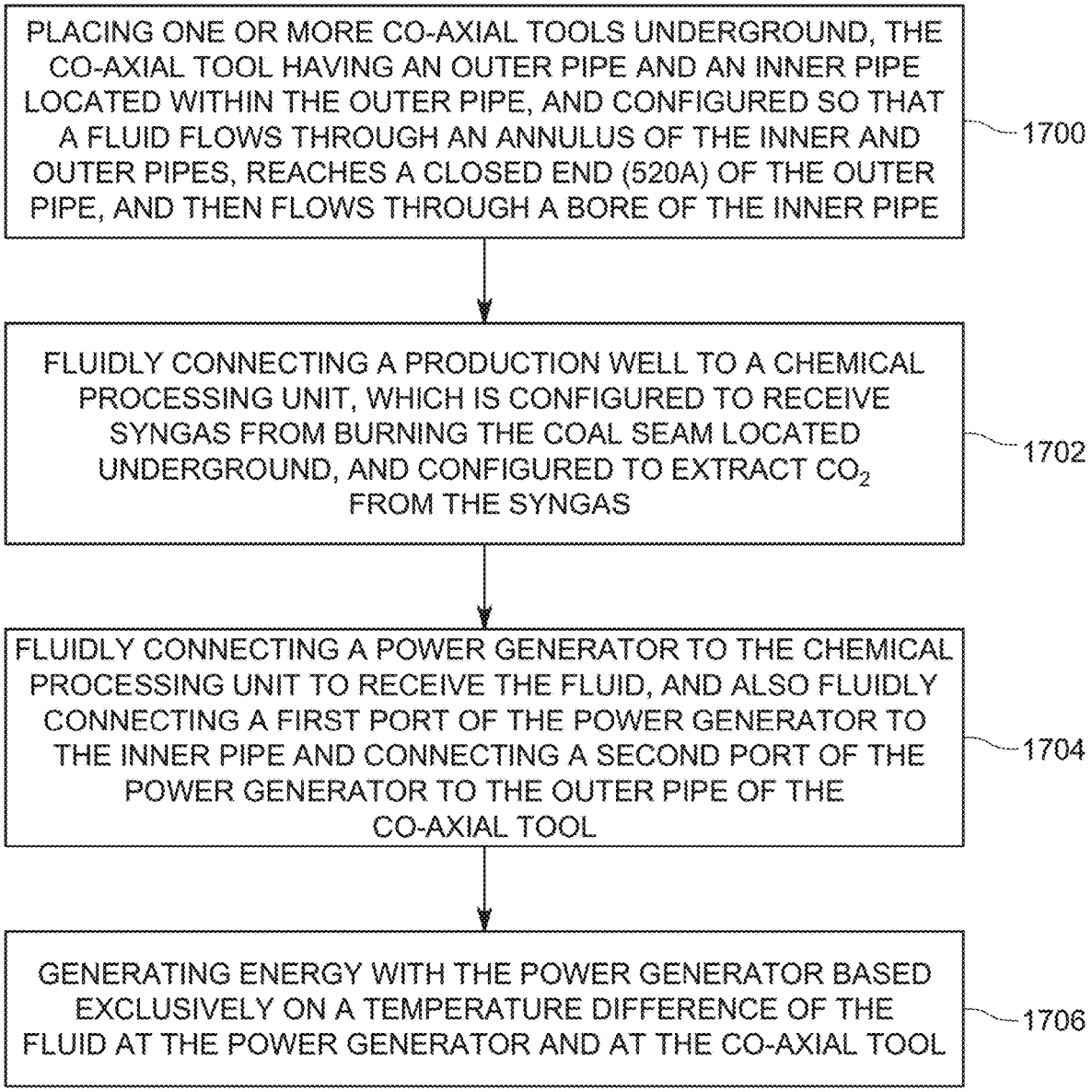
FIG. 17 is a flow chart of a method for extracting heat from a dipping burning coal underground reservoir by using a tool located under the reservoir.

The configurations shown in FIGS. 13 and 14 may be implemented in the method now discussed with regard to FIG. 17. This method for extracting heat from a reservoir includes a step 1700 of placing one or more co-axial tools 1320 underground, the co-axial tool 1320 having an outer pipe 520 and an inner pipe 510 located within the outer pipe 520, and configured so that a fluid 422 flows through an annulus 512 of the inner and outer pipes, reaches a closed end 520A of the outer pipe 520, and then flows through a bore 514 of the inner pipe 510. The fluid flow may be reversed, to flow first through the bore 514 and then through the annulus 512.

In step 1702, a production well 454 is fluidly connected to a chemical processing unit 410, which is configured to receive syngas 407 from burning the coal seam located underground, and configured to extract $CO_2$ from the syngas 407. Note that this step is optional. In step 1704, a power generator 430 is fluidly connected to the chemical processing unit 410 to receive the fluid 422, and is also fluidly connected, with a first port of the power generator, to the inner pipe 510, and fluidly connected, with a second port of the power generator, to the outer pipe 520 of the co-axial tool 1320. In step 1706, energy is generated with the power generator based exclusively on a temperature difference of the fluid 422 at the power generator and at the co-axial tool.

The method may further include a step of deploying the co-axial tool in a plane below a bottom of the coal seam, and the plane is making a non zero angle with a horizontal plane, and/or a step of deploying the co-axial tool to follow a serpentine in the plane.

The term "about" is used in this application to mean a variation of up to 20% of the parameter characterized by this term. It will be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

The disclosed embodiments provide various methods for placing one or more co-axial tools with or without a shoe in a reservoir, for extracting heat, when the reservoir exhibits one or more extreme parameters, like high temperature. It should be understood that this description is not intended to limit the invention. On the contrary, the embodiments are intended to cover alternatives, modifications and equivalents, which are included in the spirit and scope of the invention as defined by the appended claims. Further, in the detailed description of the embodiments, numerous specific details are set forth in order to provide a comprehensive understanding of the claimed invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

REFERENCES

The entire content of all the publications listed herein is incorporated by reference in this patent application.

[1] Jiang, L., Xue, D., Wei, Z., Chen, Z., Mirzayev, M., Chen, Y. and Chen, S. (2022). Coal decarbonization: A state-of-the-art review of enhanced hydrogen production in underground coal gasification. *Energy Reviews,* 1(1). doi.org/10.1016/j.enrev.2022.100004.

[2] Yang, L., Zhang, X. Y. and Zhu, K. J. (2016). Hydrogen production in underground coal gasification (UCG). Energy Sources, Part A: Recovery, Utilization, and Environmental Effects, 38(3), pp. 376-383. doi.org/10.1080/15567036.2013.770106.

[3] Olateju, B. and Kumar, A. (2013). Techno-economic assessment of hydrogen production from underground coal gasification (UCG) in Western Canada with carbon capture and sequestration (CCS) for upgrading bitumen from oil sands. Applied Energy, 111, pp. 428-440. doi.org/10.1016/j.apenergy.2013.05.014.

[4] Stańczyk, K., Kapusta, K., Wiatowski, M., Świądrowski, J., Smoliński, A., Rogut, J. and Kotyrba, A. (2012). Experimental simulation of hard coal underground gasification for hydrogen production. *Fuel,* 91(1), pp. 40-50. doi.org/10.1016/j.fuel.2011.08.024.

[5] Jiang, L., Chen, Z., Farouq Ali, S. M., Zhang, J., Chen, Y. and Chen, S. (2022). Storing carbon dioxide in deep unmineable coal seams for centuries following underground coal gasification. *Journal of Cleaner Production,* 378, p. 134565. doi.org/10.1016/j.jclepro.2022.134565.

[6] Otto, C., Kempka, T., Kapusta, K. and Stańczyk, K. (2016). Fault Reactivation Can Generate Hydraulic Short Circuits in Underground Coal Gasification-New Insights from Regional-Scale Thermo-Mechanical 3D Modeling. Minerals, 6(4), pp. 101-119. doi.org/10.3390/min6040101.

[7] Chinese Patent no. CN106121617.

[8] Chinese Patent no. CN102434143.

[9] Chinese Patent no. CN109779600.

[10] Chinese Patent no. CN209586351.

[11]U.S. Pat. No. 4,019,577.

[12] Chinese Patent no. CN215408574.

[13] Chinese Patent no. CN108534380.

[14] Chinese Patent no. CN114837648.

[15] Chinese Patent no. CN113863910.

[16] Chinese Patent no. CN111022026.

[17] Burchart-Korol, D., Korol, J. and Czaplicka-Kolarz, K., 2016. Life cycle assessment of heat production from underground coal gasification. Int J Life Cycle Assess, 21:1391-1403, DOI 10.1007/s11367-016-1102-0.

[18] Jouhara, H., Khordehgah, N., Almahmoud, S., Delpech, B., Chauhan, A. and Tassou, S. A. (2018). Waste heat recovery technologies and applications. *Thermal Science and Engineering Progress*, [online]6, pp. 268-289.

[19]U.S. patent Ser. No. 10/816,241.

[20] Chinese Patent no. CN106026778A.

[21] Chinese Patent no. CN212867523.

[22] International Application Publication WO 2017/103950.

What is claimed is:

1. A heat extraction system for extracting heat from a reservoir, the system comprising:

a chemical processing unit configured to generate a working fluid;

a co-axial tool configured to be placed underground, the co-axial tool including an outer pipe and an inner pipe arranged within the outer pipe so as to define an annulus, the outer pipe and the inner pipe each being connected to a shoe to enable the working fluid to flow through the annulus, exchange heat with the shoe, and flow through a bore of the inner pipe; and a power generator fluidly connected to the chemical processing unit so as to receive the working fluid, the power generator including a first port which fluidly connects to the inner pipe, and a second port which fluidly connects to the outer pipe, wherein a temperature differential between the working fluid at the power generator and the working fluid at the co-axial tool drives the power generator to generate energy.

2. The heat extraction system of claim 1, wherein the chemical processing unit is configured to:

receive syngas produced by burning coal in a coal seam located underground;

extract $CO_2$ and $H_2$ from the syngas; and compress the extracted $CO_2$ via a compressor so as to generate supercritical $CO_2$, which is used as the working fluid.

3. The heat extraction system of claim 2, wherein only the shoe is configured to be placed in the coal seam.

4. The heat extraction system of claim 2, further comprising:

a second compressor configured to pump air or oxygen into the coal seam so as to promote the burning of the coal.

5. The heat extraction system of claim 1, wherein the shoe is made of a material that withstands temperatures greater than 500° C., wherein the co-axial tool further includes a first flexible coupling configured to connect the outer pipe to the shoe so as to enable the outer pipe to thermally expand and contract without leaking the working fluid, and wherein the inner pipe and the outer pipe cooperate so as to form an uninterrupted loop path which places the working fluid in direct contact with the shoe as the working fluid circulates between a top of the annulus and a top of the bore.

6. The heat extracting system of claim 5, wherein the co-axial tool further includes:

a strainer element located between the inner pipe and the shoe, the strainer element including a plurality of holes; and a second flexible coupling configured to connect the inner pipe to the strainer element, wherein the working fluid circulates between the annulus and the bore via the plurality of holes.

7. A method for extracting heat from a reservoir, the method comprising:

generating a working fluid via a chemical processing unit;

placing one or more co-axial tools underground, each co-axial tool including an outer pipe and an inner pipe arranged within the outer pipe so as to define an annulus, the outer pipe and the inner pipe each being connected to a shoe so as to enable the working fluid to flow through the annulus, exchange heat with the shoe, and flow through a bore of the inner pipe such that only the shoe is in contact with a coal seam located underground;

supplying the working fluid to a power generator fluidly connected to the chemical processing unit;

fluidly connecting a first port of the power generator to the inner pipe of the one or more co-axial tools, and fluidly connecting a second port of the power generator to the outer pipe of the one or more co-axial tools; and driving the power generator so as to generate energy based on a circulation of the working fluid and a temperature differential between the working fluid at the power generator and the working fluid at the one or more co-axial tools.

8. The method of claim 7, further comprising:

fluidly connecting a production well to the chemical processing unit, the production well configured to receive syngas produced by burning coal in the coal seam;

extracting $CO_2$ from the syngas via the chemical processing unit; and compressing the $CO_2$ into supercritical $CO_2$, which is used as the working fluid.

9. The method of claim 8, further comprising:

circulating the supercritical $CO_2$ through the annulus, the shoe, and the bore of the one or more co-axial tools so as to extract heat from the burning coal in the coal seam; and circulating the heated supercritical $CO_2$ through the power generator so as to produce electrical energy.

10. The method of claim 9, further comprising:

when the heat has been extracted, injecting the supercritical $CO_2$ into a cavity left behind by the burned coal in the coal seam; and sealing wells connected to the cavity so as to store the $CO_2$ underground.

11. The method of claim 8, further comprising:

injecting air or oxygen into the coal seam so as to sustain the burning of the coal.

12. The method of claim 8, further comprising:

extracting $H_2$ from the syngas via the chemical processing unit.

13. A heat extraction system for extracting heat from a reservoir, the system comprising:

a chemical processing unit configured to generate a working fluid;

a co-axial tool configured to be placed underground, the co-axial tool including an outer pipe and an inner pipe arranged within the outer pipe so as to define an annulus configured to convey the working fluid to a closed end of the outer pipe and through a bore of the inner pipe; and a power generator fluidly connected to the chemical processing unit so as to receive the working fluid, the power generator including a first port which fluidly connects to the inner pipe, and a second port which fluidly connects to the outer pipe, wherein a temperature differential between the working fluid at the power generator and the working fluid at the co-axial tool drives the power generator to generate energy.

14. The heat extraction system of claim 13, wherein the chemical processing unit is configured to:

receive syngas produced by burning coal in a coal seam located underground;

extract $CO_2$ and $H_2$ from the syngas; and compress the extracted $CO_2$ via a compressor so as to generate supercritical $CO_2$, which is used as the working fluid.

15. The heat extraction system of claim 14, wherein the co-axial tool is configured to be placed under a bottom of the coal seam at an angle which deviates from a vertical.

16. The heat extraction system of claim 14, further comprising:

a second compressor configured to pump air or oxygen into the coal seam so as to promote the burning of the coal.

17. The heat extraction system of claim 13, wherein the inner pipe and the outer pipe cooperate so as to form an uninterrupted loop path which places the working fluid in direct contact with the closed end of the outer pipe as the working fluid circulates between a top of the annulus and a top of the bore.

18. A method for extracting heat from a reservoir, the method comprising:

generating a working fluid via a chemical processing unit;

placing one or more co-axial tools underground, each co-axial tool including an outer pipe and an inner pipe arranged within the outer pipe so as to define an annulus configured to convey the working fluid to a closed end of the outer pipe and through a bore of the inner pipe;

supplying the working fluid to a power generator fluidly connected to the chemical processing unit to receive the working fluid, and also fluidly connecting a first port of the power generator to the inner pipe of the one or more co-axial tools, and fluidly connecting a second port of the power generator to the outer pipe of the one or more co-axial tools; and driving the power generator so as to generate energy based on a circulation of the working fluid and a temperature differential between the working fluid at the power generator and the working fluid at the one or more co-axial tools.

19. The method of claim 18, further comprising:

deploying the one or more co-axial tools along a plane below a bottom of a coal seam, the plane extending at a non-zero angle with respect to a horizontal plane.

20. The method of claim 19, further comprising:

deploying the one or more co-axial tools so as to follow a serpentine trajectory along the plane.

* * * * *